US005199618A

United States Patent [19]

Reil et al.

[11] Patent Number: 5,199,618

[45] Date of Patent: Apr. 6, 1993

[54] POURING DEVICE FOR CONTAINER FOR FLOWABLE MATERIAL

[75] Inventors: Wilhelm Reil, Bensheim; Ulrich Deutschbein, Muhltal; Gerd Knobloch, Griesheim; Udo Liebram, Pfungstadt, all of Fed. Rep. of Germany

[73] Assignee: Tetra Alfa Holdings S.A., Pully, Switzerland

[21] Appl. No.: 621,615

[22] Filed: Nov. 30, 1990

[30] Foreign Application Priority Data

Dec. 2, 1989 [DE] Fed. Rep. of Germany ..... 3939970
Apr. 11, 1990 [EP] European Pat. Off. ..... 90106964.1

[51] Int. Cl.[5] ..... B65D 47/10

[52] U.S. Cl. ..... 222/541; 222/556; 220/258; 220/259; 220/269

[58] Field of Search ..... 222/541, 545, 546, 556; 229/123.3, 125.08, 125.09, 125.14; 220/258, 259, 265, 268, 269, 270

[56] References Cited

U.S. PATENT DOCUMENTS

| | | | |
|---|---|---|---|
| 2,098,763 | 11/1937 | Sebell | 222/541 |
| 3,039,669 | 6/1962 | Hill | 229/17 |
| 3,441,168 | 4/1969 | Luviano | 220/53 |
| 3,807,595 | 4/1974 | Zundel | 220/27 |
| 3,923,198 | 12/1975 | Brochman | 220/359 |
| 4,289,250 | 9/1981 | Jordan | 220/270 |
| 4,391,385 | 7/1983 | Rausing | 220/270 |
| 4,705,197 | 11/1987 | Gordon et al. | 222/556 |
| 4,852,764 | 8/1989 | Stone | 220/315 |
| 4,986,465 | 1/1991 | Jacobsson et al. | 220/269 |

FOREIGN PATENT DOCUMENTS

| | | | |
|---|---|---|---|
| 0318606 | 6/1989 | European Pat. Off. . | |
| 3808303 | 9/1989 | Fed. Rep. of Germany . | |
| 19247 | 1/1990 | Japan | 229/123.3 |
| 8002410 | 11/1980 | World Int. Prop. O. | 220/268 |

*Primary Examiner*—Andres Kashnikow
*Assistant Examiner*—Philippe Derakshani
*Attorney, Agent, or Firm*—Howard M. Ellis; Michael L. Dunn

[57] ABSTRACT

Described is a pouring device of plastic material for fitting to the hole of a flowing medium pack, wherein the pouring device (10) has a portion (20) which is openable by means of a tearing line (25). So that packs of widely different configurations and consisting of a wide range of different materials can be produced in such a way as to be sealed and easily openable, the pouring device (10) has at least a bottom portion (20) and a closure portion (21) which are pivotally movably connected together by way of a hinge (22), wherein the tearing line (25) is disposed in the bottom portion (20).

The process for the production of such a pouring device is characterised in that a series of blanks which are arranged in succession in a flat condition and which are in line-wise contact with each other are formed from an endless web of plastic material which can be subjected to deep drawing, and rolled up to form a coil, and the blanks are separated off prior to fitting to the hole in the pack.

8 Claims, 18 Drawing Sheets

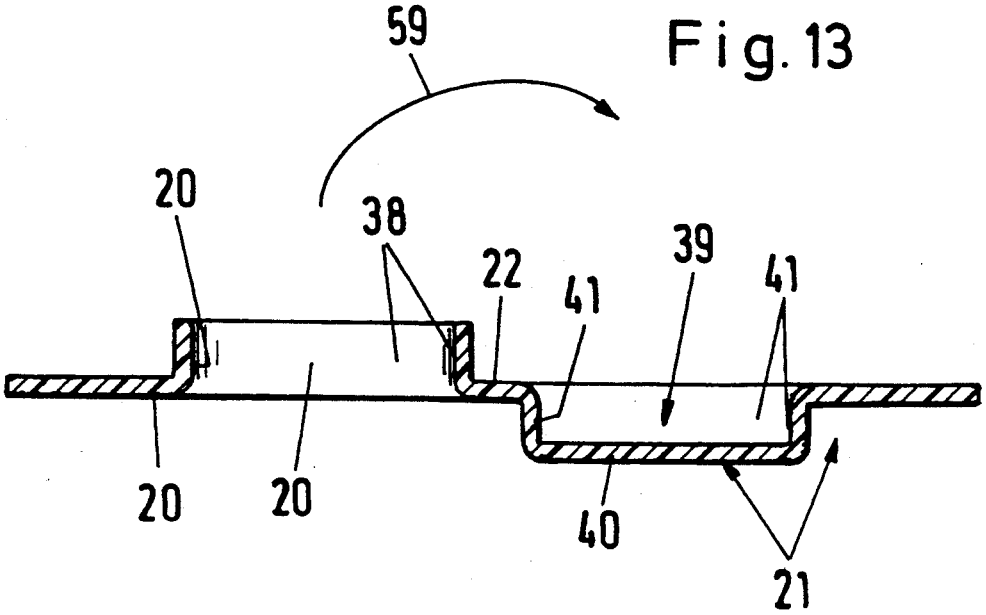
Fig. 13
Fig. 14
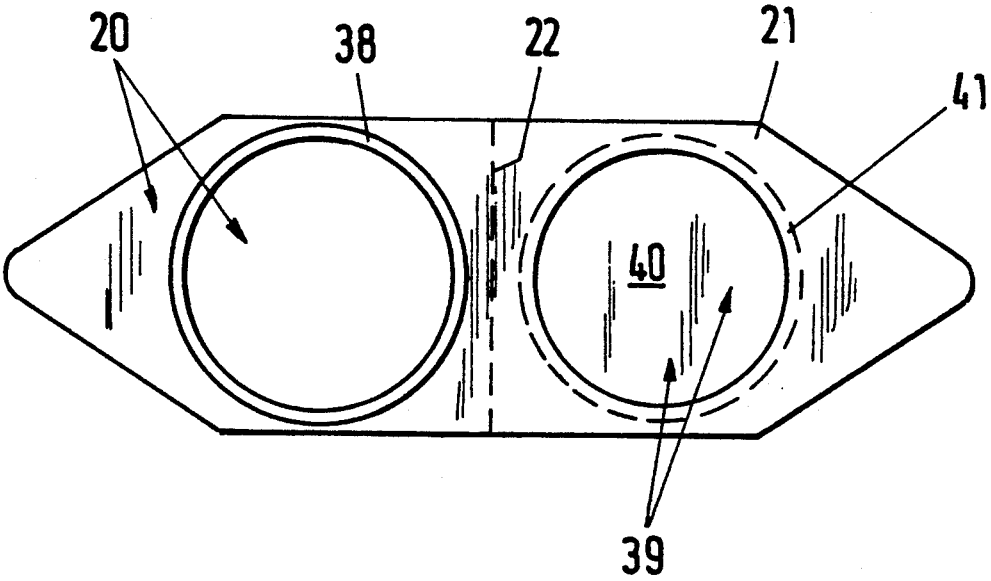

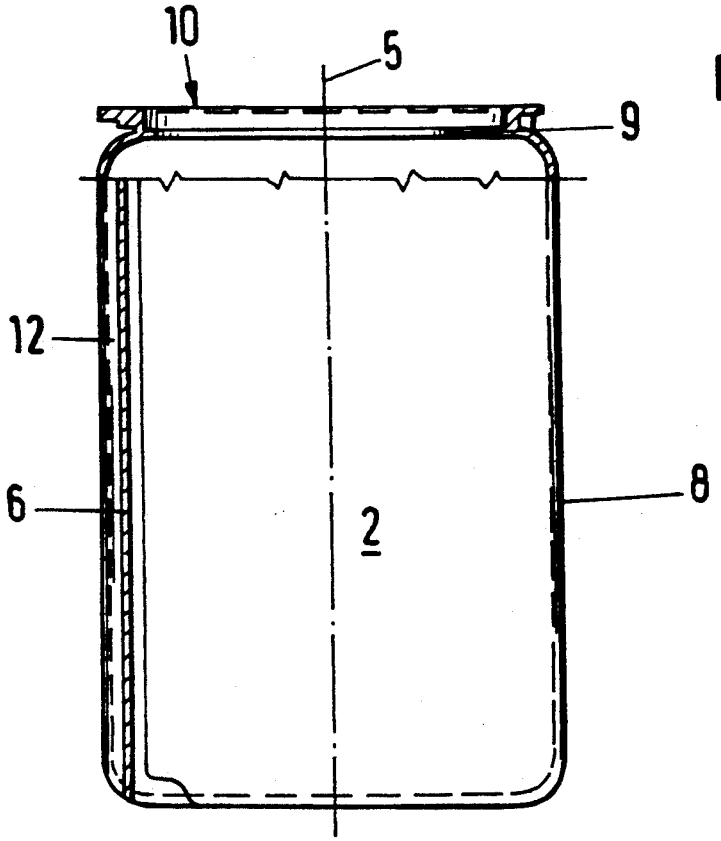
Fig.28
Fig.29
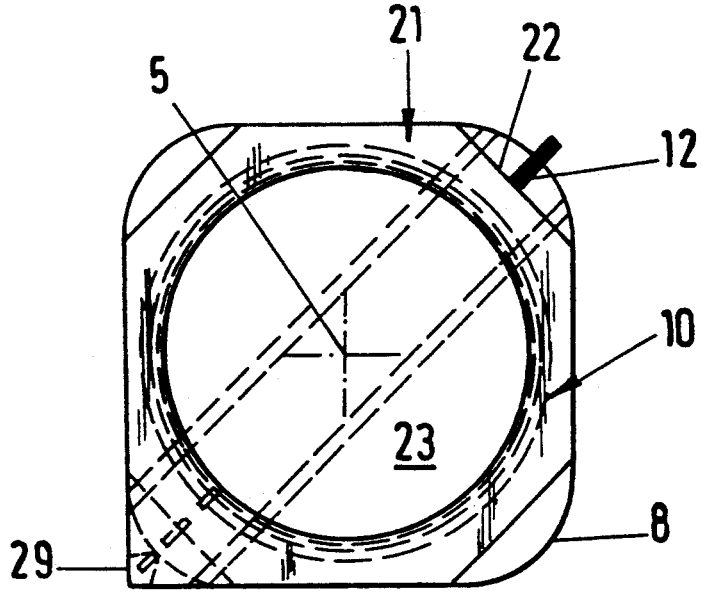

POURING DEVICE FOR CONTAINER FOR FLOWABLE MATERIAL

The invention relates to a pouring device of plastic material for fitting to a hole of a pack for filling material which is capable of flow, wherein the pouring device has a portion which is openable by means of a tearing line.

It is basically possible for filling material to be poured out through the hole in a pack which is generally in the upper end wall thereof, without particular additional devices. In accordance with the present invention however a portion of a particular configuration, consisting of thermoplastic material, is generally referred to as a pouring device because it is only when such a pouring device is used that a flowing medium pack can be emptied in an expedient manner, for example with a clearly defined pouring jet.

Many packs have a pouring device and packs are also known which consist of plastic-coated paper, in the upper wall of which was stamped or punched a hole which is closed by a separate pouring device. Such a known pouring device can be opened by means of a tearing line, by a given portion of the pouring device being torn up or completely torn away. Prior to the tearing operation therefore the hole in the top wall of the pack is completely closed for example for storage and transportation of the pack. The end consumer can then open the pouring device in the described manner by means of the tearing line.

The object of the invention is to provide a pouring device for packs, by means of which packs of widely varying configurations and consisting of a very wide range of different materials can be properly sealed, on the ore hand, in order for example to ensure storage and transportation without the risk of leakage, while on the other hand they are also easily openable by the user. Another object of the invention is a process for the production of a pouring device of plastic material, which can be produced in a reliable and economical manner even in large numbers per unit of time.

According to the invention, a pouring device with which the above-indicated object can be attained is characterised in that it has at least a bottom portion and a closure portion which are pivotally movably connected together by way of a hinge and that the tearing line is disposed in the bottom portion.

A flowing medium pack which is provided with a pouring device of that nature only needs to have a hole at its top wall, without the necessity to provide particular additional measures for closing, opening and possibly re-closing the pack. As a result the pack manufacturer enjoys a great deal of liberty in regard to the design configuration of his pack. A pouring device according to the invention can be prefabricated and stored beside a pack producing machine so that the pack can be closed with such a pouring device, prior to or after the respective filling operation thereof, and nonetheless can be used by the user in a highly expedient manner. The novel pouring device is of a very simple design configuration for it comprises two portions which are connected together by way of a hinge and a tearing line is provided only in one portion, namely the bottom portion which is directly connected to the top wall of the pack.

It is particularly desirable for the plastic material to be weldable. It is also possible to use for the pouring device plastic material which is capable of undergoing deep drawing, for example a thermoplastic material such as polypropene. PVC can also serve as such a plastic material, polypropene also being widely known in the art as polypropylene. The pouring device according to the invention then consists of portions and materials which can be satisfactorily re-processed and which easily degrade, in contrast to many known pouring devices consisting of composite materials of for example paper and plastic material. In a particularly preferred embodiment the plastic material, for example polypropene, may also be filled, in which respect chalk, mica, talc, gypsum or the like is envisaged here as filling materials. In practice degrees of filling of up to 70% and preferably 60% have proven to be advantageous. It has been found that on the one hand filled plastic materials of that kind are easily degradable, can be re-processed or recycled readily and using simple methods and on the other hand do not adversely affect the properties of a plastic material so that filled plastic materials of that kind in particular can be subjected to deep drawing and are also sealable.

It has been found that the pouring device is particularly advantageous in terms of design configuration and use when in accordance with the invention the bottom portion is sealed to the closure portion at least along a part of the tearing line. A sealing seam can be provided in such a fashion, for example by the application of heat by means of pressure by way of suitable sealing jaws, that, when the closure portion is torn up, the bottom portion tears along the sealing seam so that the latter satisfactorily predefines the tearing line. That then involves a particular configuration of the tearing line which in general terms and in accordance with the description set forth hereinbefore, does not in any way have to be in the form of a sealing seam. Conventional tearing lines are perforated lines or cross-sectional portions of material along the tearing line, which have been considerably weakened in terms of their cross-section, relative to the adjoining material.

In accordance with a further configuration of a preferred embodiment, it is provided that, in accordance with the invention, the closure portion has a cup-shaped depression with a bottom and an upstanding collar or rim at the edge thereof. The collar is then practically the cylindrical side wall of the cup and the bottom of the depression is the bottom of the cup. The depression in the closure portion affords the manufacturer of the pouring device the option of using the upstanding collar to fix the pouring device to the edge of the hole in a pack, which for example has a ring of a correspondingly cylindrical configuration. A simple way of joining plastic portions is welding by means of a welding jaw and a co-operating or backing jaw, and the cup-shaped depression in the closure portion advantageously affords the space to arrange tools to provide the jaw and the co-operating jaw in the region of the collar.

In that connection however it should be pointed out at this stage that the operation of fixing the pouring device according to the invention to the edge of a hole in a pack for material which is capable of flow may also be effected by way of other surfaces of the bottom portion, namely the generally flat main surface of the bottom portion which is laid over the edge of the hole in the pack and secured in position there. More detailed information is set out below.

The cup-shaped depression in the closure portion is particularly desirable, in a further embodiment of the invention which is of an advantageous configuration and in which the pouring device is characterised in that the bottom portion has a cup-shaped depression with a bottom and an upstanding collar or rim at the edge thereof, wherein the tearing line is arranged in the bottom of the bottom portion. When reference was made hereinbefore to fixing the pouring device to an upstanding edge of the hole in a pack, with the advantage of disposing a jaw and a co-operating jaw in the cup-shaped depression, then that involves in particular the last-mentioned embodiment in which it is admittedly sufficient to provide the bottom portion with a cup-shaped depression, but in which it is particularly advantageous for both portions of the pouring device to have a cup-shaped depression, the depressions advantageously even being of such dimensions relative to each other that the cup-shaped depression in the closure portion can be pushed into the depression in the bottom portion. In that embodiment the inside diameter of the depression in the bottom portion is therefore approximately the same size as the outside diameter of the cup-shaped depression in the closure portion.

Welding to the edge of the hole in the pack, when such edge is upstanding parallel to the collar or rim of the cup-shaped depression in the bottom portion is effected along an annular line at the outer surface of the collar or rim of the cup-shaped depression in the bottom portion.

It is also advantageous if, in accordance with the invention, a gripping means of a plate-like or ring-like configuration is disposed at a location on the closure portion, preferably in diametrally opposite relationship to the hinge. It is preferably of a similar form to the closure portion, preferably in such a way that it does not project substantially beyond the outside surface of the closure portion, if possible only by an amount corresponding to the thickness of the material. If the pouring device is made for example from a foil of plastic material which is of a thickness of from 0.5 to 3 mm and preferably from 1 to 2 mm, then the gripping means therefore can only be allowed to project by for example 1.5 mm beyond the outermost surface of the pouring device, which extends substantially parallel to the upper end wall of the pack. In that way the pouring device can be of a very flat and shallow configuration, that is to say with a minimum dimension in respect of height. The pack manufacturer is therefore inclined to use a pouring device according to the invention because it is of a practical design configuration, economical to produce and takes up so little space that in a pack of a suitable configuration, it can be disposed completely within the outside contour thereof, as will be shown by a specific embodiment described hereinafter.

In accordance with another advantageous embodiment of the invention the tearing line in the bottom of the bottom portion is closed in itself and preferably extends along a line which is round or polygonal or has a tip. Making tearing lines in the form of perforated lines in flowing medium packs of coated paper is known per se. Making tearing lines of such a configuration that they are closed in themselves is also known per se in relation to plastic foils. It is however a novel point which has not been suggested in relation to any pack for a pouring device to be designed in the above-indicated manner and for a tearing line to be provided in the bottom of the cup configuration of the bottom portion, with the aim of opening the bottom portion in the manner which is precisely predetermined by the tearing line. That embodiment is also particularly advantageous when, for the purposes of tearing away the remaining piece of the bottom of the bottom portion, there is provided a surface which completely covers that remaining piece, for example the bottom of the closure portion. In relation to another configuration of the closure portion in which for example there is not a cup-like bottom produced by deep drawing, that configuration of the tearing line would be of no use. There are also bottom portions of different configurations, without such a bottom, so that in those cases also the specific tearing line is unimportant or is omitted.

The tearing line with the tip is arranged in such a way that the tip is disposed at that location where the tearing-open force first comes to the tearing line in order to concentrate the tearing-open forces at the punctiform tip and to facilitate the operation of tearing open the arrangement and in that way precisely to guarantee the configuration of the opening which is torn open.

It is also advantageous in accordance with the invention if almost all outer surfaces of the bottom portion can be covered outwardly by the closure portion, in the closed condition of the pouring device.

The above-indicated surfaces of the closure portion are the surfaces which can come into contact with the content of the pack and on which the pack content can remain at least in part after the pack has been partially emptied, with the result that it is from that location that contamination collects or is formed in the case of bacteria. Dust and other dirt particles endanger in particular those surfaces of a pouring device on a flowing medium pack which, even when the content of the pack is poured out for the first time, come into contact with the content of the pack or can come into contact therewith. If all those parts are flat, that is to say if more or less the entire surface of all those parts is correctly covered over, then the level of hygiene of such a pack is considerably improved. The pouring device according to the invention therefore already provides for an improvement from the point of view of hygiene, irrespective of the design configuration of the pack.

In a further preferred embodiment of the invention, the pouring device is characterised in that the bottom portion has a collar which extends around the cup-shaped depression of the closure portion and which at its end towards the closure portion is provided with a transversely radially outwardly projecting annular surface having outside edges which converge on the side in opposite relationship to the hinge and in relation to which the tearing line is arranged as a straight desired-rupture line for forming a pouring edge. It will be seen that that a different construction from those described hereinbefore. Reference was made hereinbefore to a kind of pouring device in which the bottom portion does not have for example a bottom which extends substantially parallel to the bottom of the depression of the closure portion. It is such a construction which is involved here. With that kind of pouring device, it is possible to save material, more specifically in the region of the bottom portion for although the latter has a collar whose outer end which is towards the closure portion can be of a similar configuration to the above-described embodiments, at the opposite end however it is free and does not connect into a bottom.

With such a construction, it would be possible for filling material of the pack to pass between the bottom portion and the closure portion, at least in small amounts, and even come into contact with the surroundings and the sources of dirt represented thereby, unless in a further embodiment of the invention it were provided that the bottom portion has a common outside edge with the closure portion and both portions are fluid-tightly welded together along said common outside edge. There are admittedly numerous kinds of flowing media in relation to which welding along a common outside edge, as just described, is not required. However particularly when dealing with liquids of low viscosity, there is a need for welding of the common outside edge because that ensures that all lines are fluid-tight relative to the interior of the pack.

If a pouring device of the kind described herein is considered, then a—preferably straight—edge of the closure portion, more specifically the edge along which the hinge connecting to the bottom portion extends, will be fluid-tight by virtue of its being in the form of a pivotal and folding connection, while on the other substantially U-shaped lines, along the common outside edge, welding of the closure portion to the bottom portion provides for fluid-tight sealing integrity. It is then within the above-mentioned substantially U-shaped or also V-shaped weld line at the common outside edge that the cup-shaped depressions or at least one of the cup-shaped depressions, namely that in the closure portion, is or are arranged. Such a pouring device is totally and hermetically sealed relative to the exterior.

When again looking on to the closure portion from above, the tearing line which was mentioned hereinbefore in the form of a straight desired-rupture line for the purposes of forming a pouring edge is so arranged that, when considering the weld line which extends in a U-shape or a V-shape configuration, it intersects the weld line at a small spacing from the base of the U-shape or the base of the V-shape (the tip of the V-shape). The tip of the U-shape or the V-shape forms so-to-speak the gripping tip of the pouring device which the user grips and pulls upwardly away from the top wall of the pack. When that is done, the tearing line ruptures so that, on the closure portion which has been pulled up, the gripping tip, having been torn away from the bottom portion, remains hanging on the closure portion and is pulled up in a hinge-like manner. That operation of tearing open the pack is effected with the weld line being opened, along the common outside edge. If now therefore the cup-shaped depression of the closure portion is pulled out of the bottom portion, the hole of the pack is then in an opened condition. The tearing-open operation is effected along the preferably straight edge of the rupture line formed by the tearing-open operation, so that the desired-rupture line forms a pouring edge. The above-mentioned outside edge of the bottom portion performs the function of the pouring edge.

In the last-described embodiment, the preferably straight desired-rupture line extends at a spacing of from 2 to 10 mm and preferably from 3 to 7 mm from the base of the U-shape or the tip of the V-shape. Nonetheless the sealing weld line extends from one end of the hinge to the other end in a U-shape or a V-shape, whereby the pouring device and the pack connected thereto is rendered fluid-tight. If the end of the pouring device which is adjacent the pouring edge is defined as the front end, then the tearing line which extends preferably parallel to the fold line with the hinge at the front is the rupture line while the described line which extends in a U-shape or V-shape is a sealing or weld line. That is not inconsistent with the fact that the rupture line which as a desired-rupture line is a weakening line, is also produced by sealing and is therefore a welded seam which ultimately performs the function of a tearing line.

From the point of view of the manufacturer of the above-described pouring device, a process which is of particular attraction is one which, by virtue of simple steps and using only small amounts of material, is capable of providing a pouring device having a bottom portion which is openable by means of a tearing line and a closure portion, which portions are pivotally movably connected together by way of a hinge. In accordance with the invention, to provide such a pouring device, it is provided that a series of blanks which are disposed in succession and which are essentially in a lying-flat condition and which are in contact with each other in a point-wise and/or line-wise manner are formed from an endless web of plastic material which can be subjected to deep drawing, and rolled up to form a coil, and the blanks are separated off prior to fitting to the hole in the pack.

Depending on the respective configuration of the pouring device, juxtaposed blanks are in contact with each other in a point-wise and/or line-wise manner after they have been deep drawn and stamped or punched out. In accordance with the invention the blanks are advantageously only separated off when they are fed to a machine which is not described herein and by means of which the pouring device is fitted to a pack or the like. Before that, although they have also been subjected to a preliminary treatment, the blanks remain in the form of a string of interconnected blanks, that is to say, it is always possible to handle a line and possibly a very long line of some hundred blanks or pouring devices.

In that connection it is particularly preferred if, in accordance with the invention, the blanks are formed by deep drawing and stamping or punching and waste which has been stamped or punched out is preferably recycled. The blanks which are initially in a condition of lying flat are subjected to deep drawing if portions which are to be deep drawn are included in the device, preferably the closure portion with the cup-shaped depression and/or the bottom portion with a depression. When the deep drawing operation has been carried out on the continuous web of plastic material, the stamping or punching operation is effected so that the blanks are admittedly still in the form of a continuous web or a line of blanks, but they are only in contact with each other in a point-wise and/or line-wise manner, and are already provided with any portions which are deep drawn. In the stamping or punching operation, waste portions necessarily occur, and the particular choice of the above-described plastic material means that it is simple and sensible to recycle same.

It is also desirable if in accordance with the invention the blanks, prior to being rolled up, are folded into themselves, fitted together and partially welded. It would be possible to envisage blanks in a completely flat condition being rolled up to form a coil. It has already been mentioned above however that in accordance with the invention the blanks are subjected to deep drawing if desired prior to the stamping or punching operation. Nonetheless the blanks which have possibly been subjected to deep drawing and punching or stamping operations are still in a line or row of banks which are in contact with each other in succession so that such row or line or a web could be rolled up to form a coil. However it has been found particularly advantageous if, in accordance with the last-mentioned steps, the blanks which have been already subjected to the deep drawing and stamping or punching operations are initially folded into themselves, for example along a fold line which serves as a hinge, in which case a gripping means is possibly additionally applied. If the pouring device to be produced in accordance with the process even requires a weld line, whether it is to be a desired-rupture line, whether it is to be a tear-open line which is closed in itself, or whether a plurality of such lines and/or a sealing line must be produced at a common outside edge, then that welding operation is also to be carried out on the blank prior to the separation thereof, so as to produce a pouring device which is almost complete and which is still in the condition of a line or web by virtue of the fact that the one pouring device is still connected to the next. Such a line of pouring devices is then rolled up to form a coil, in accordance with the teaching of the invention, and is available for further processing operations. For example such a roll or coil can be used in a closure machine by virtue of the pouring devices being separated off individually and then fitted to the respective pack.

Further advantages, features and possible uses of the present invention will be apparent from the following description of preferred embodiments with reference to the accompanying drawings in which:

FIGS. 10 to 14 show a third embodiment of a pouring device according to the invention; therein:

Figure 1:
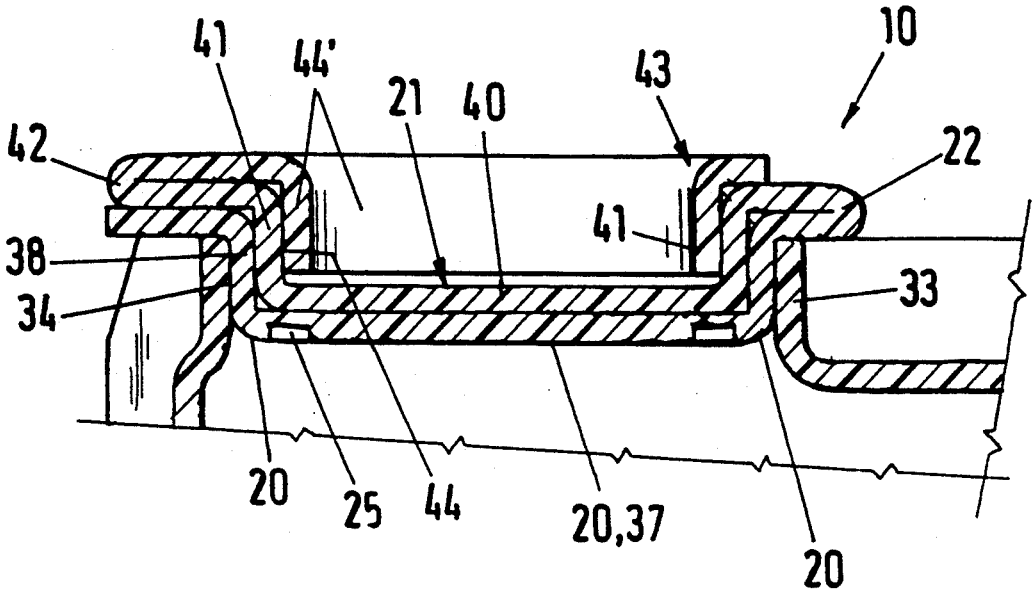
FIGS. 1 to 4 show a first embodiment.
Figure 2:
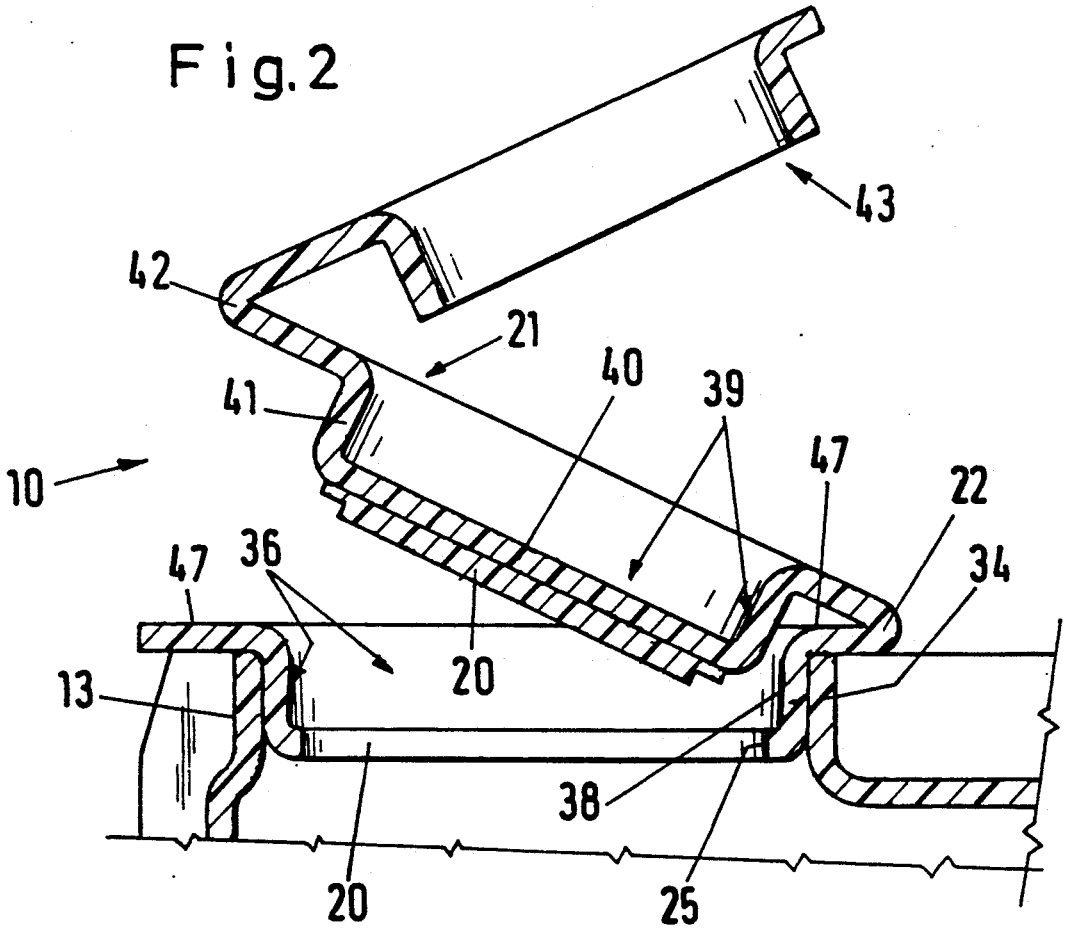
Figure 3:
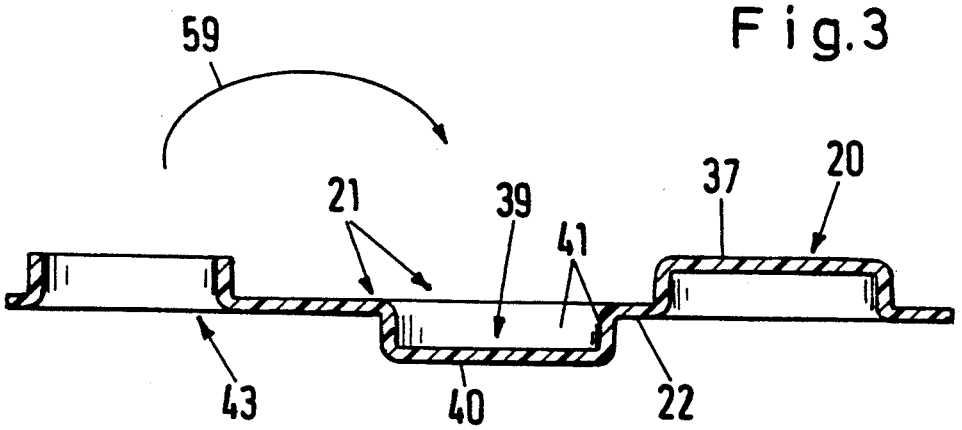
Figure 4:
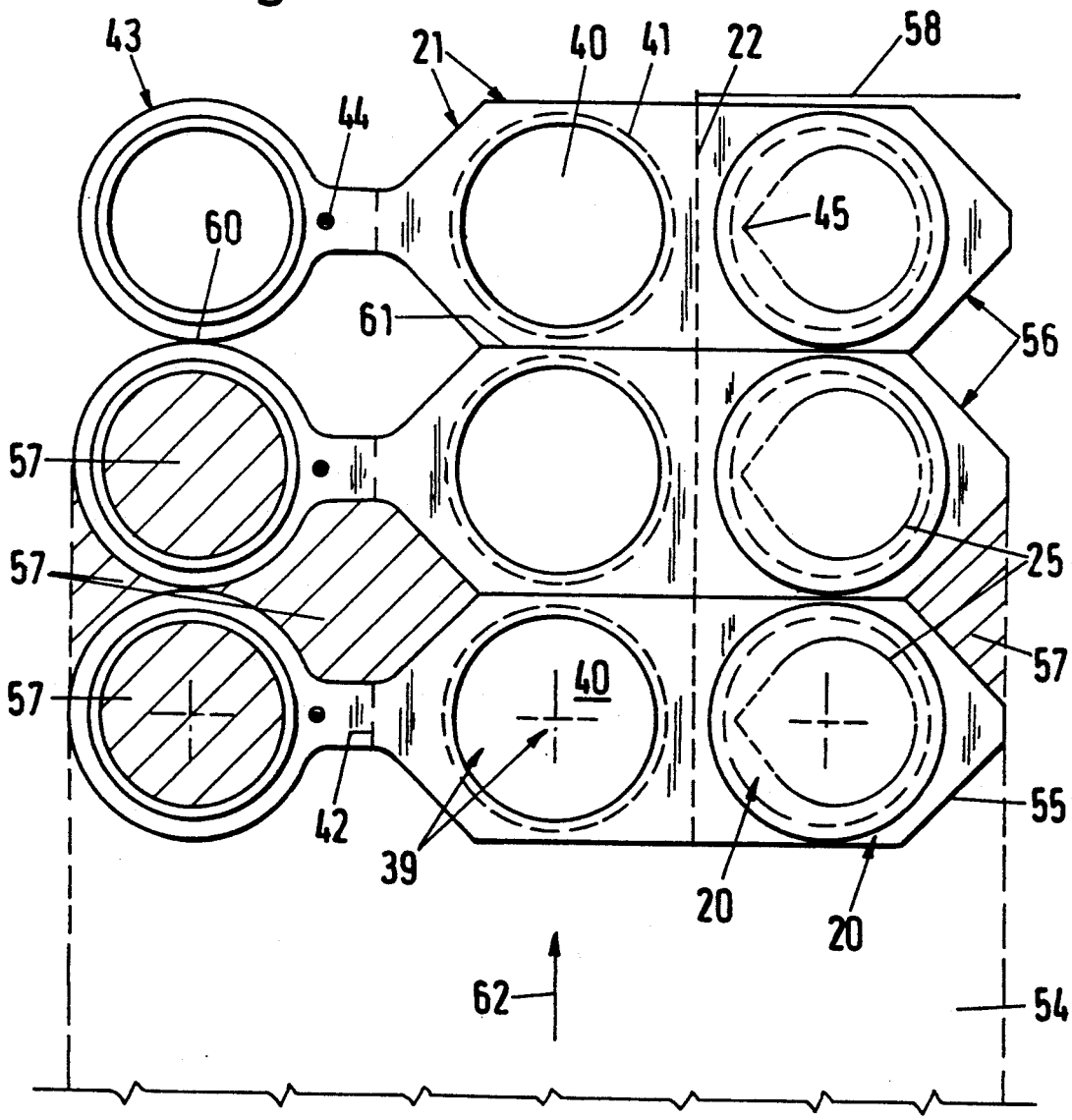
Figure 5:
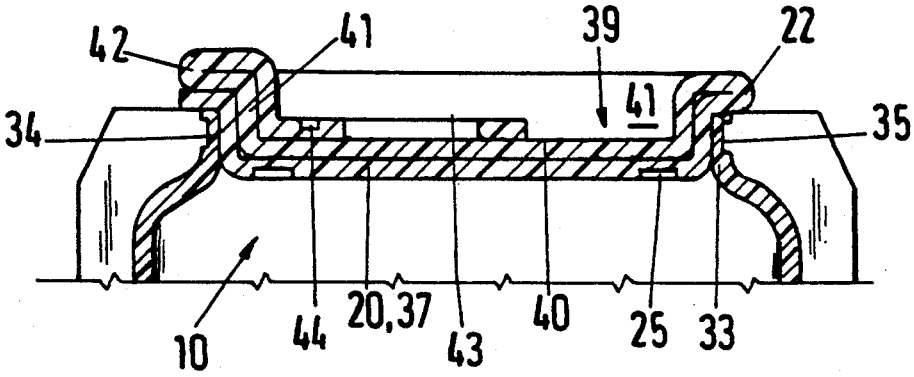
FIGS. 5 to 9 show a second embodiment.
Figure 6:
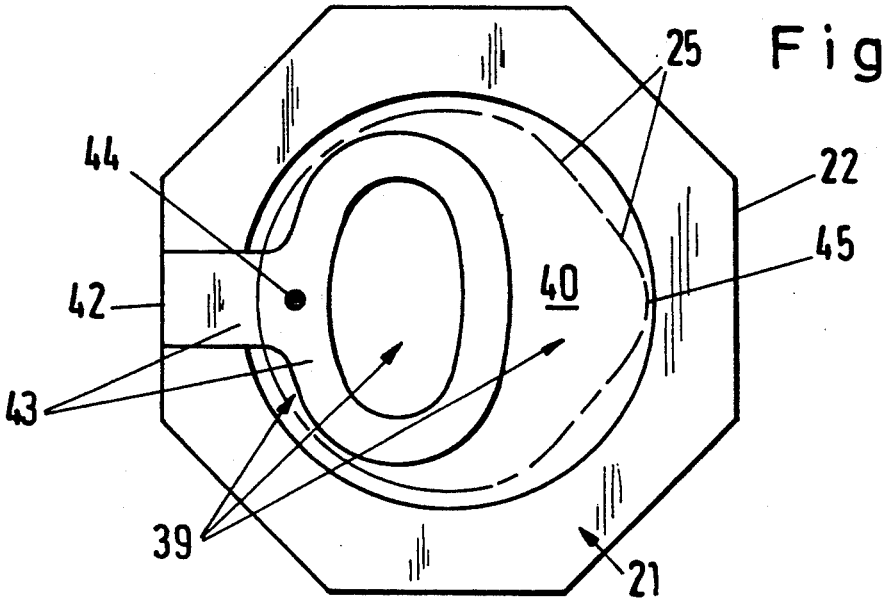
Figure 7:
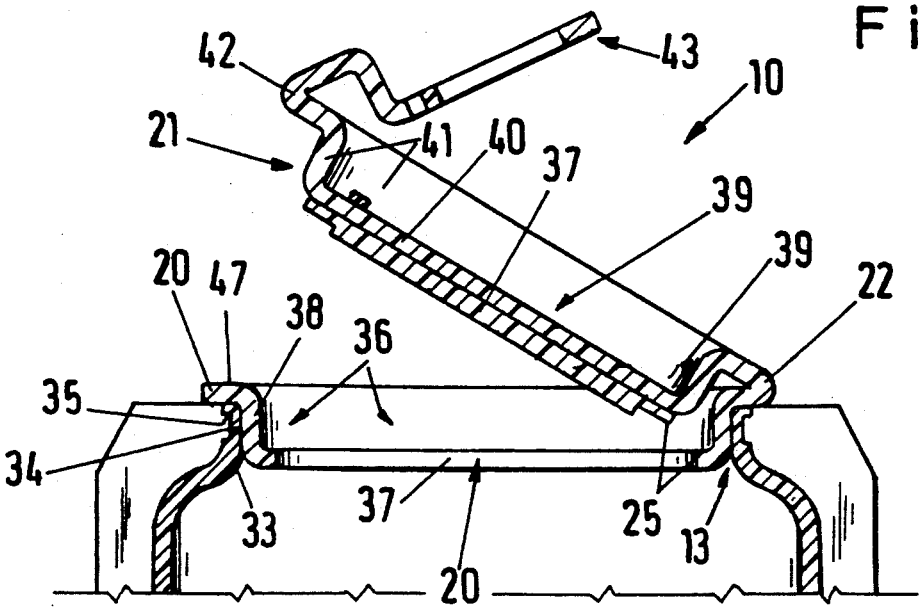
Figure 8:
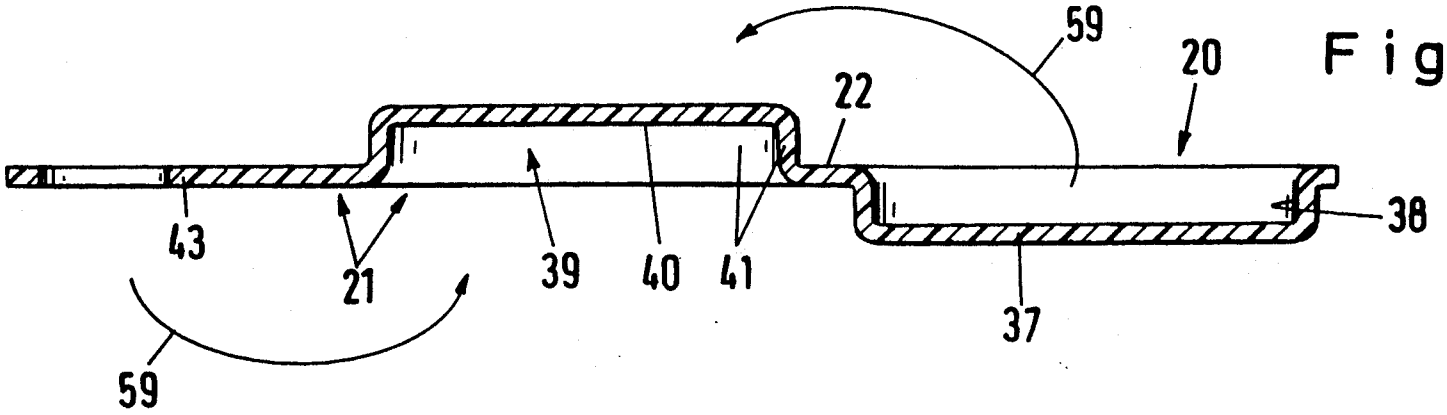
Figure 9:
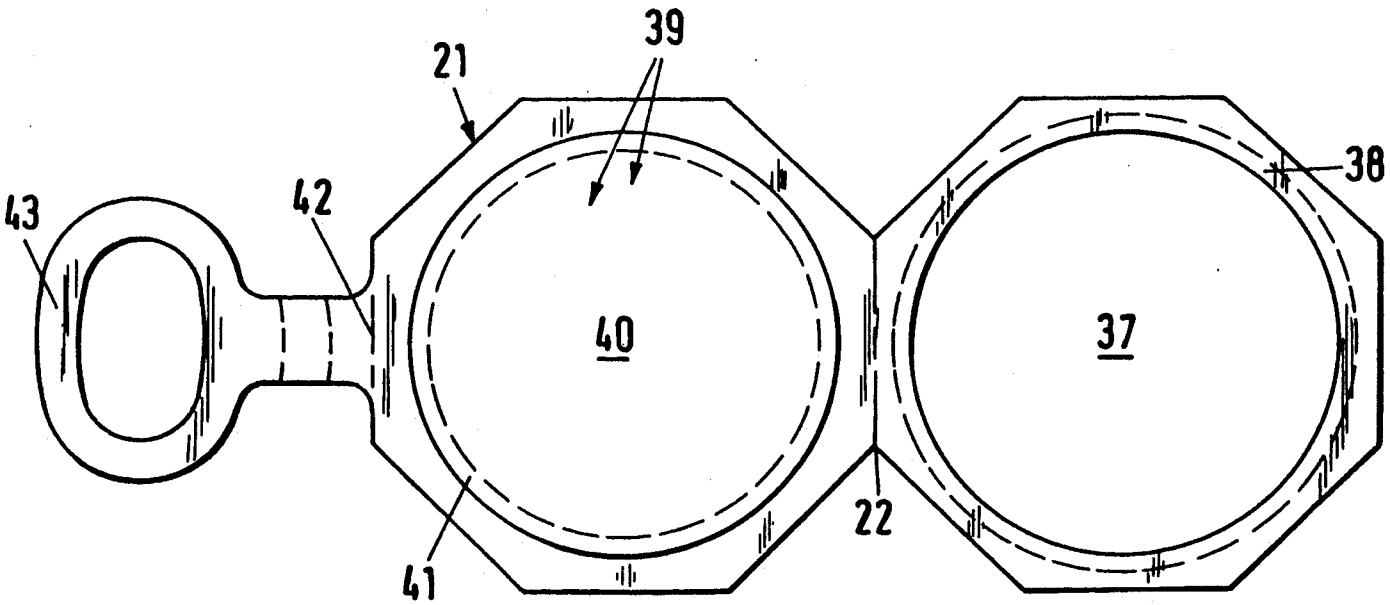
Figure 10:
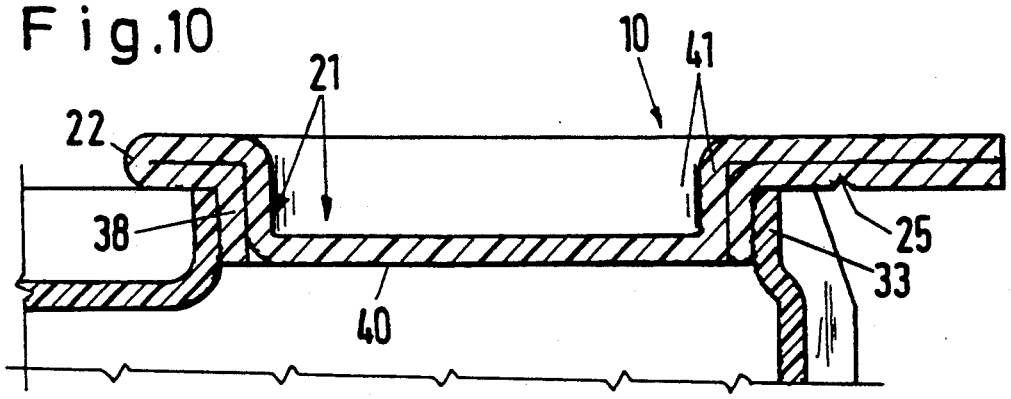
Figure 11:
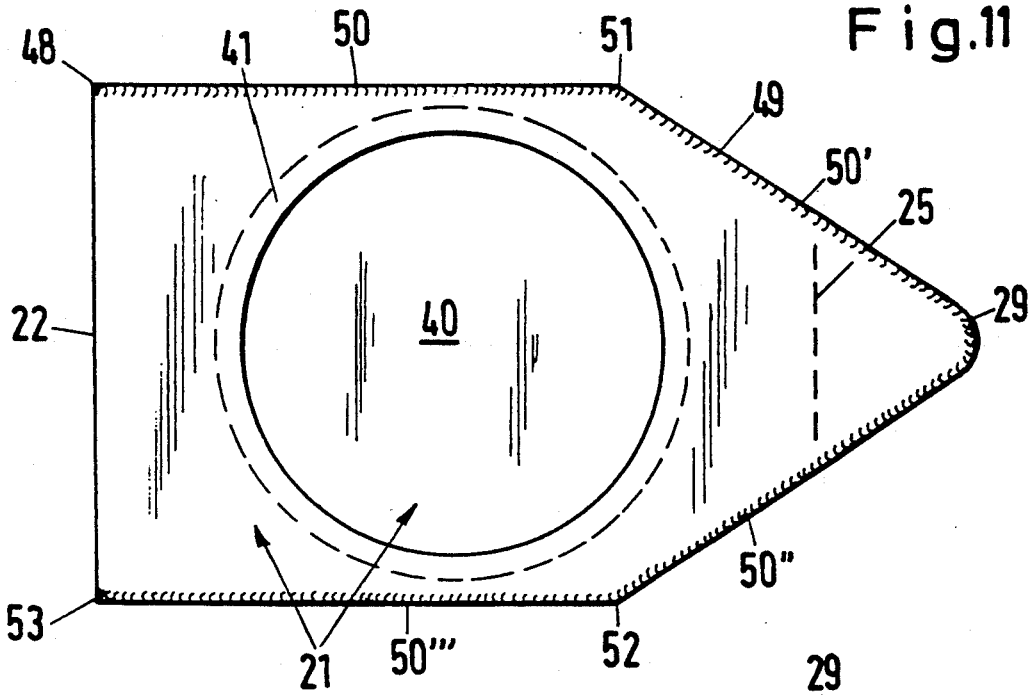
Figure 12:
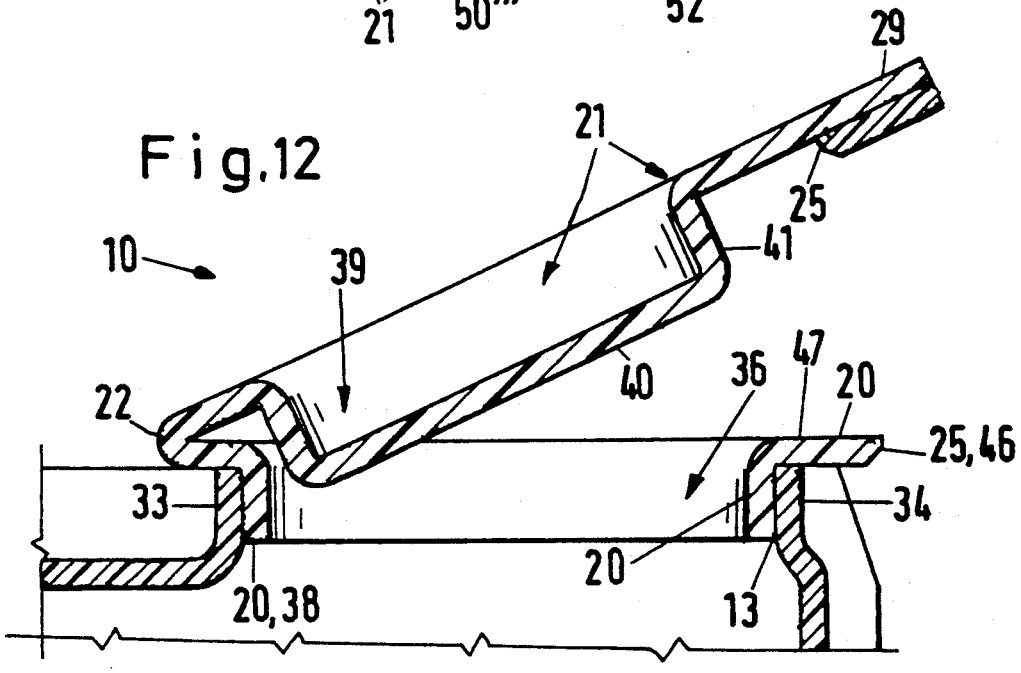
Figure 15:
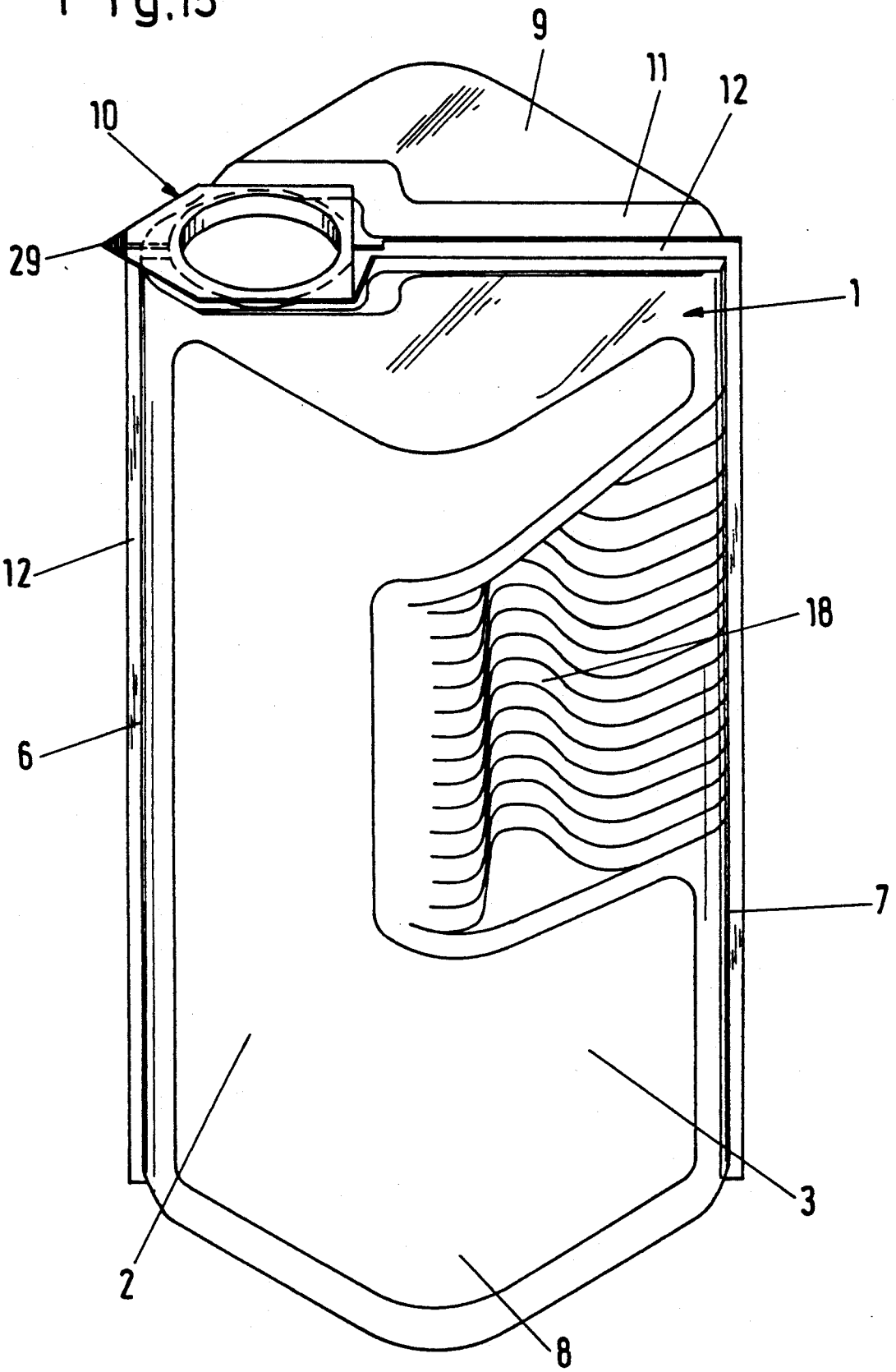
Figure 16:
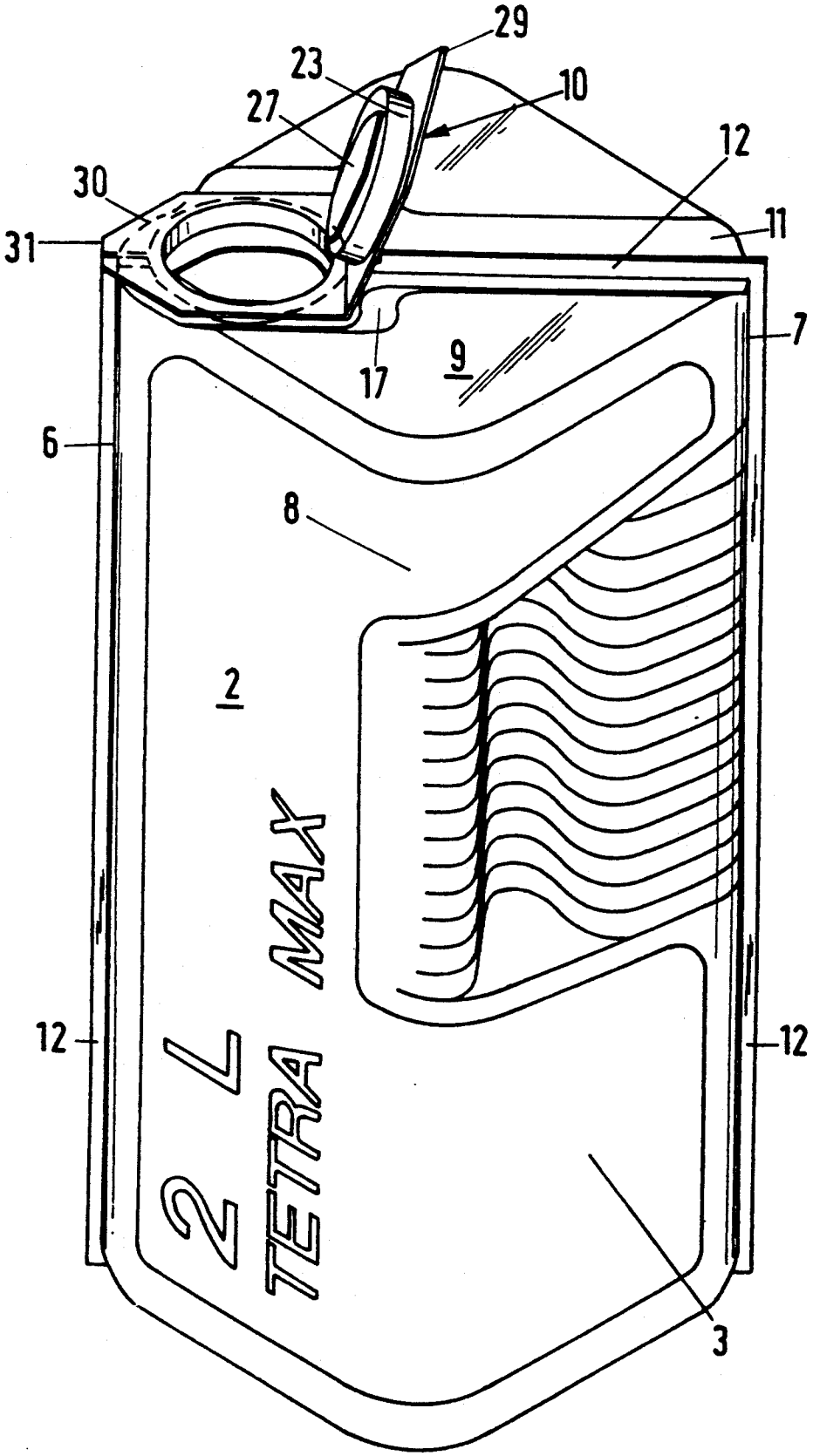
Figure 17:
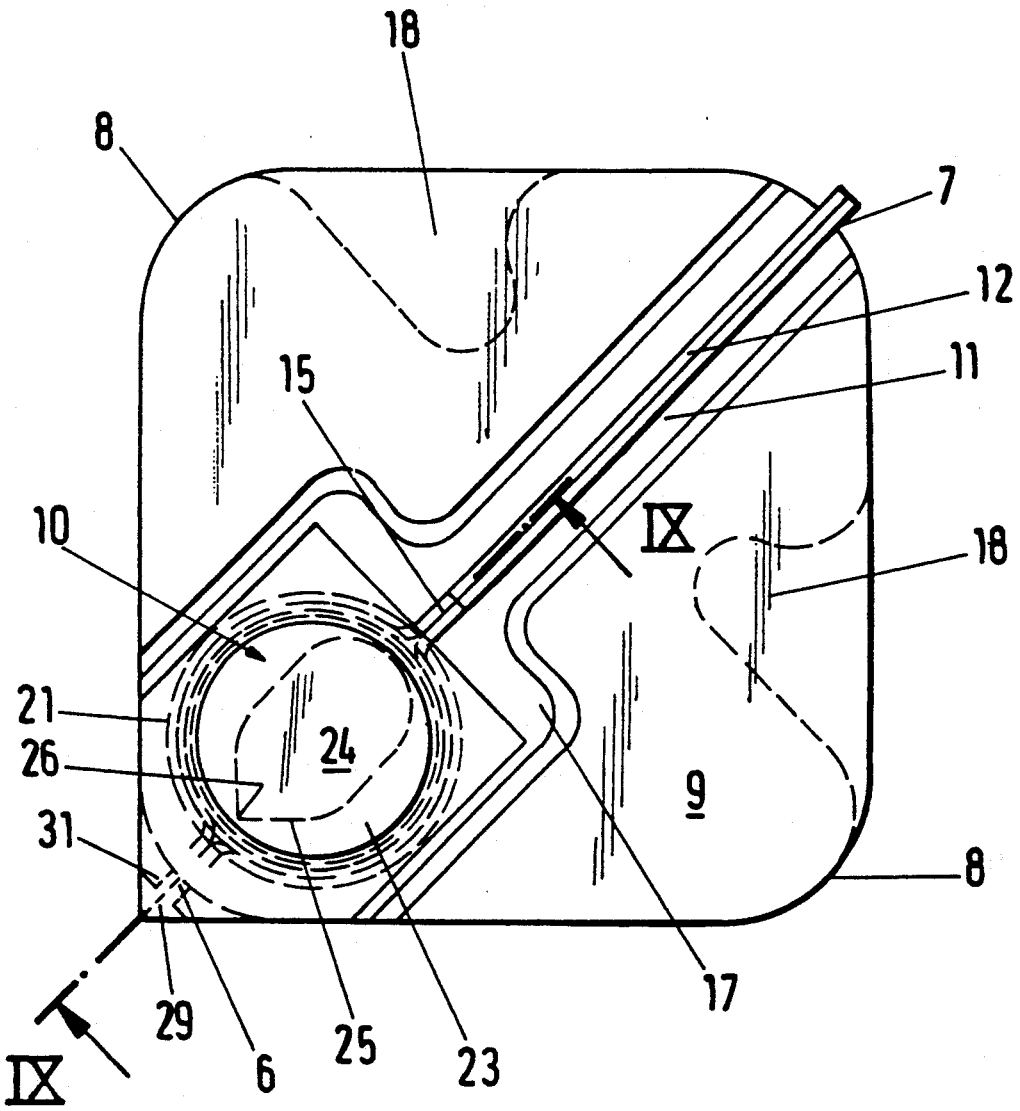
Figure 18:
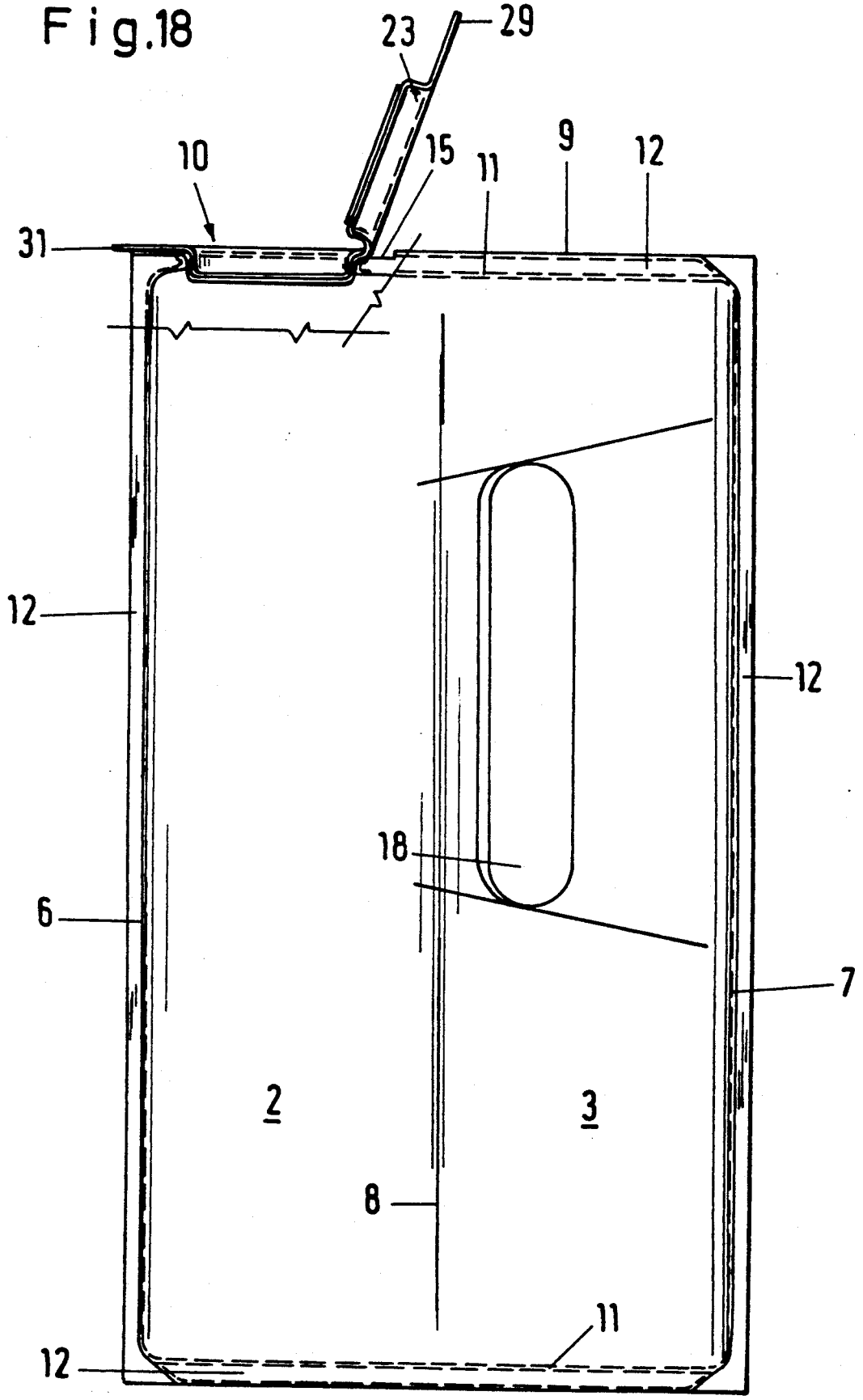
Figure 19:
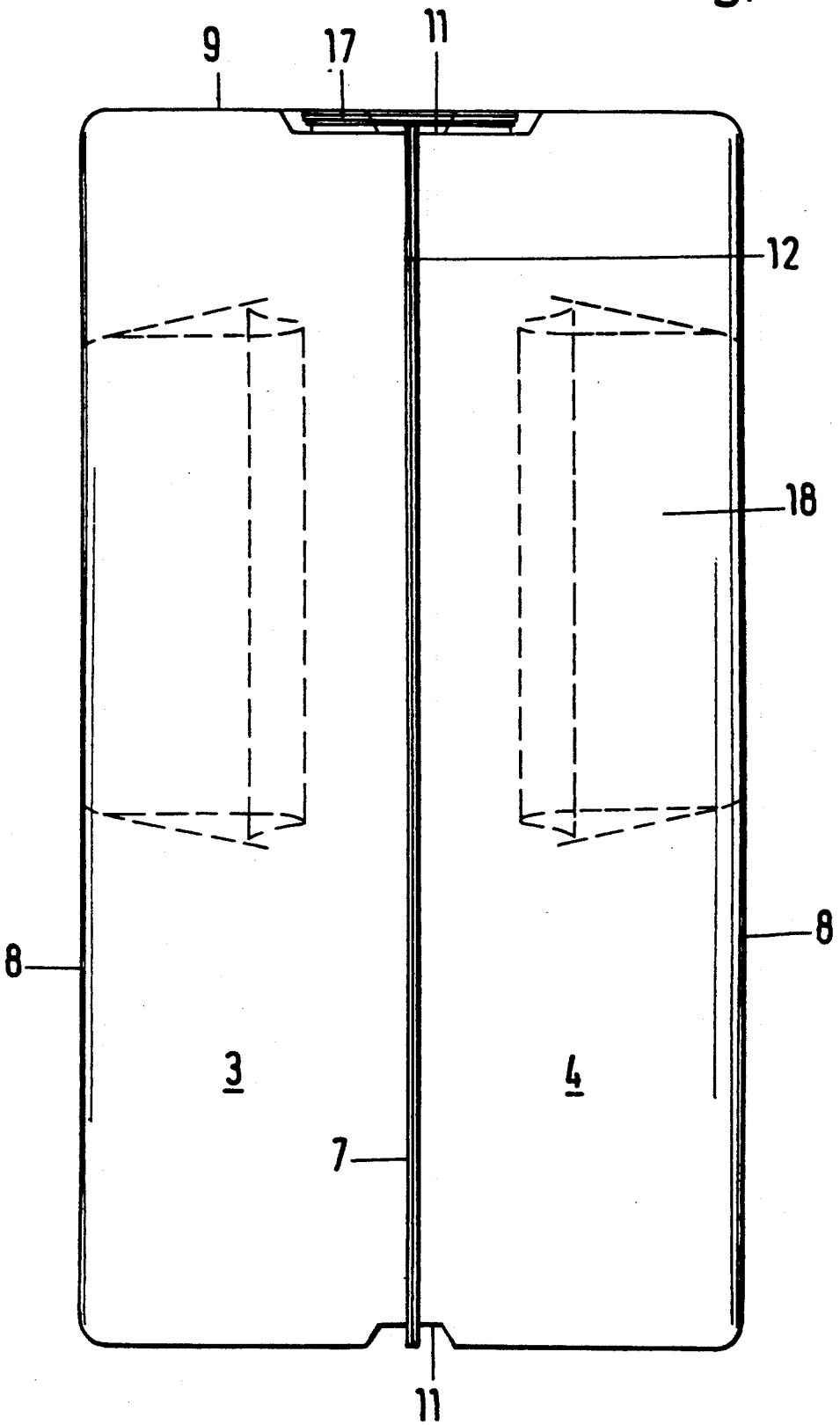
Figure 20:
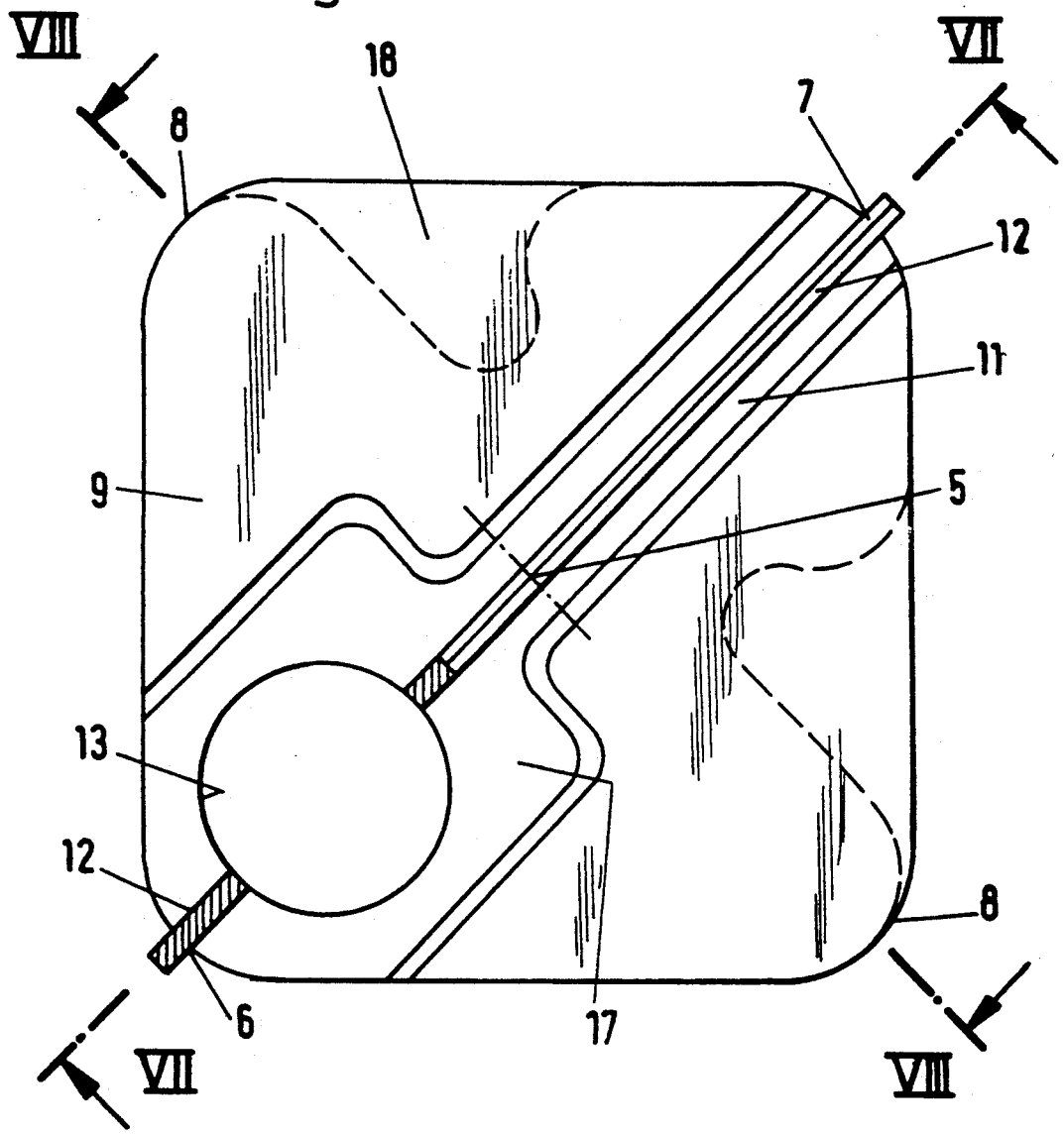
Figure 21:
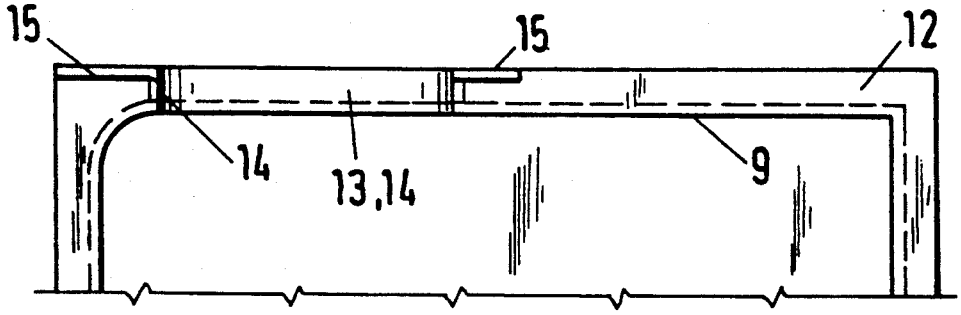
Figure 22:
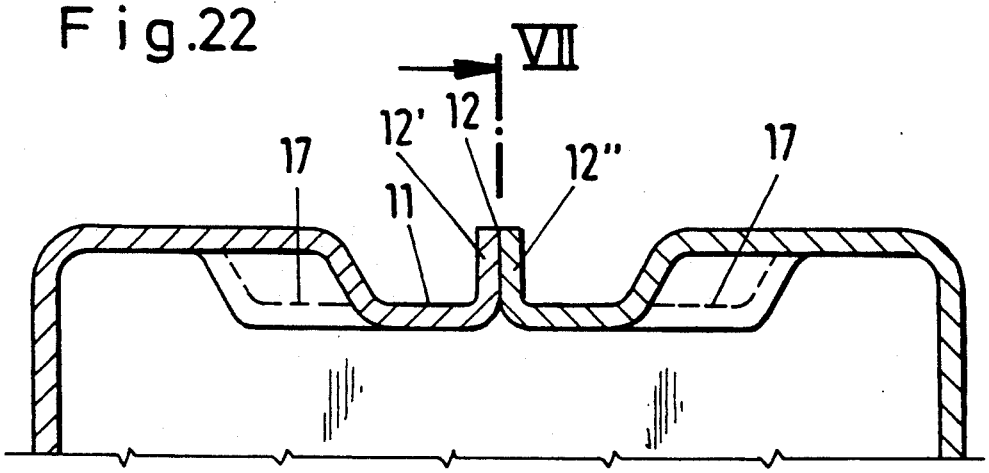
Figure 23:
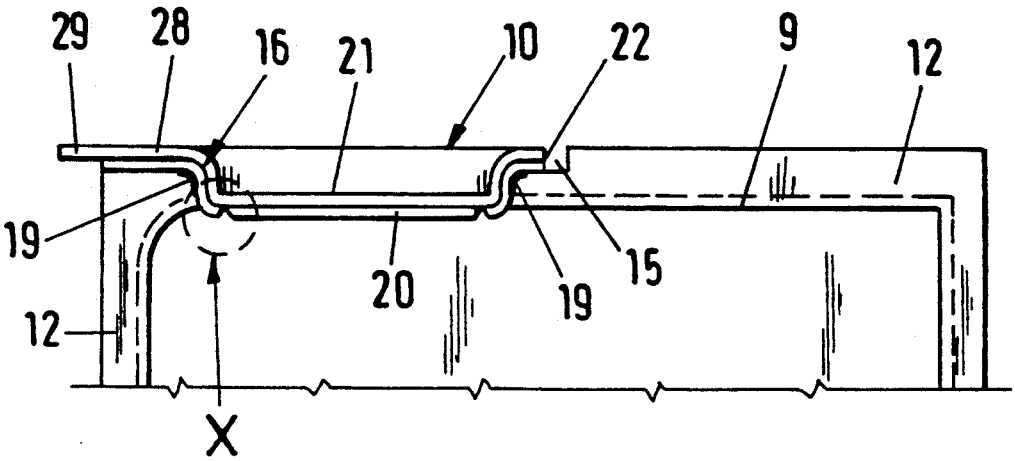
Figure 24:
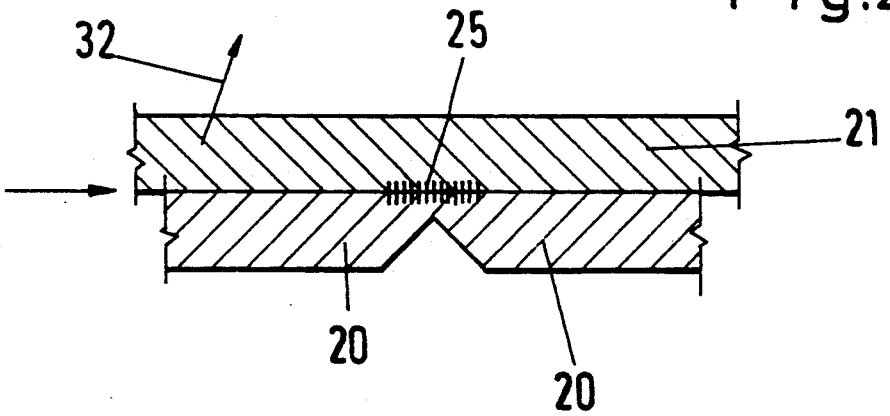
Figure 25:
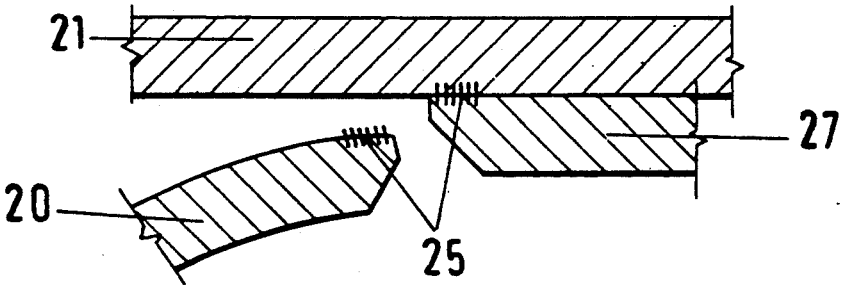
Figure 26:
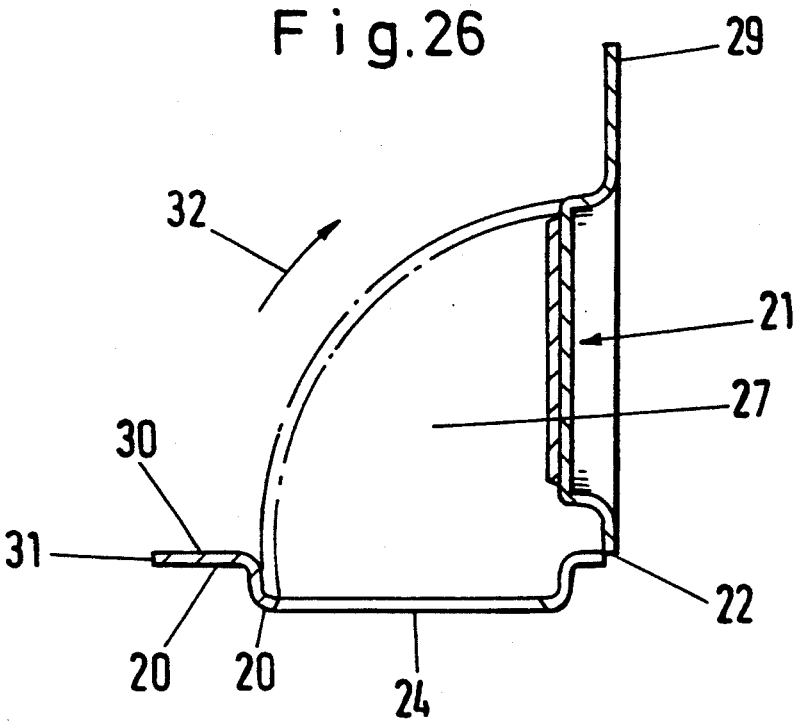
Figure 27:
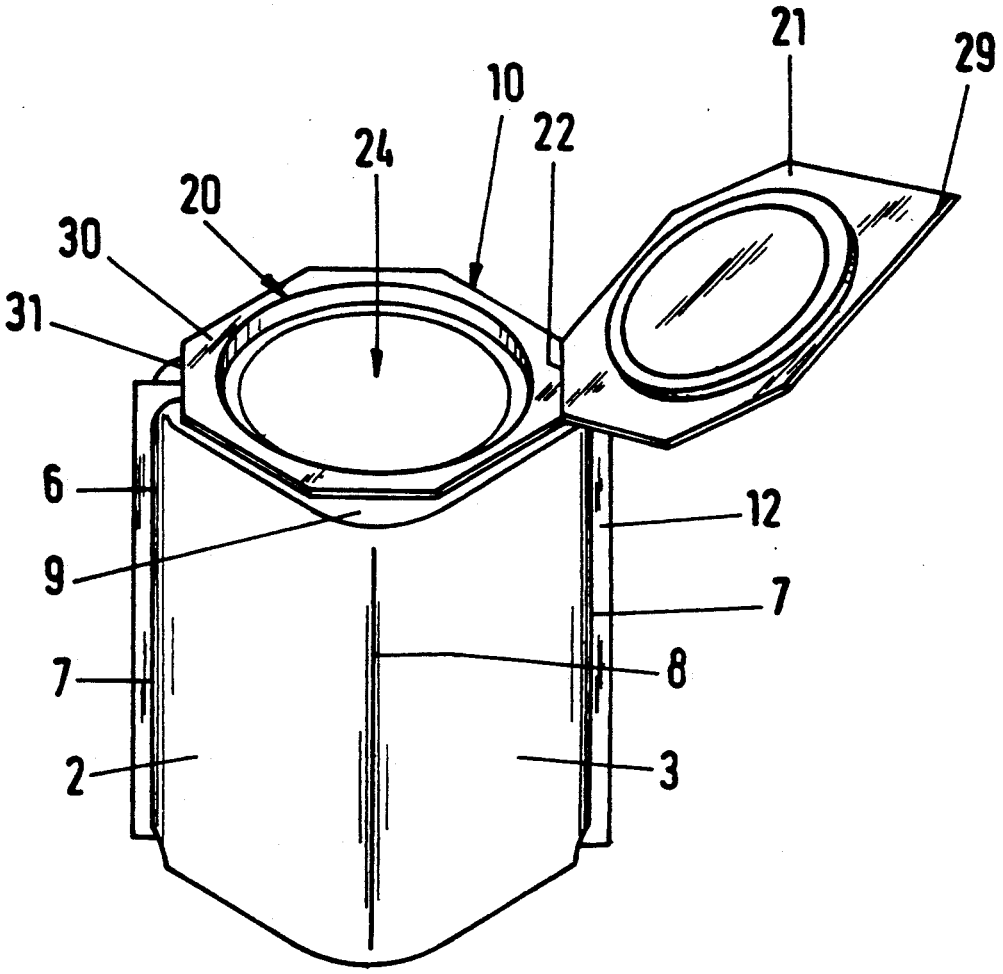
Figure 30:
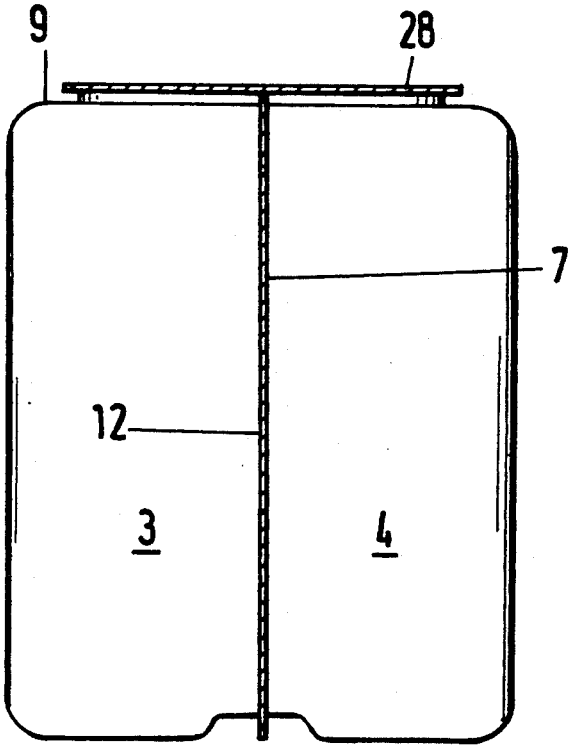
Figure 31:
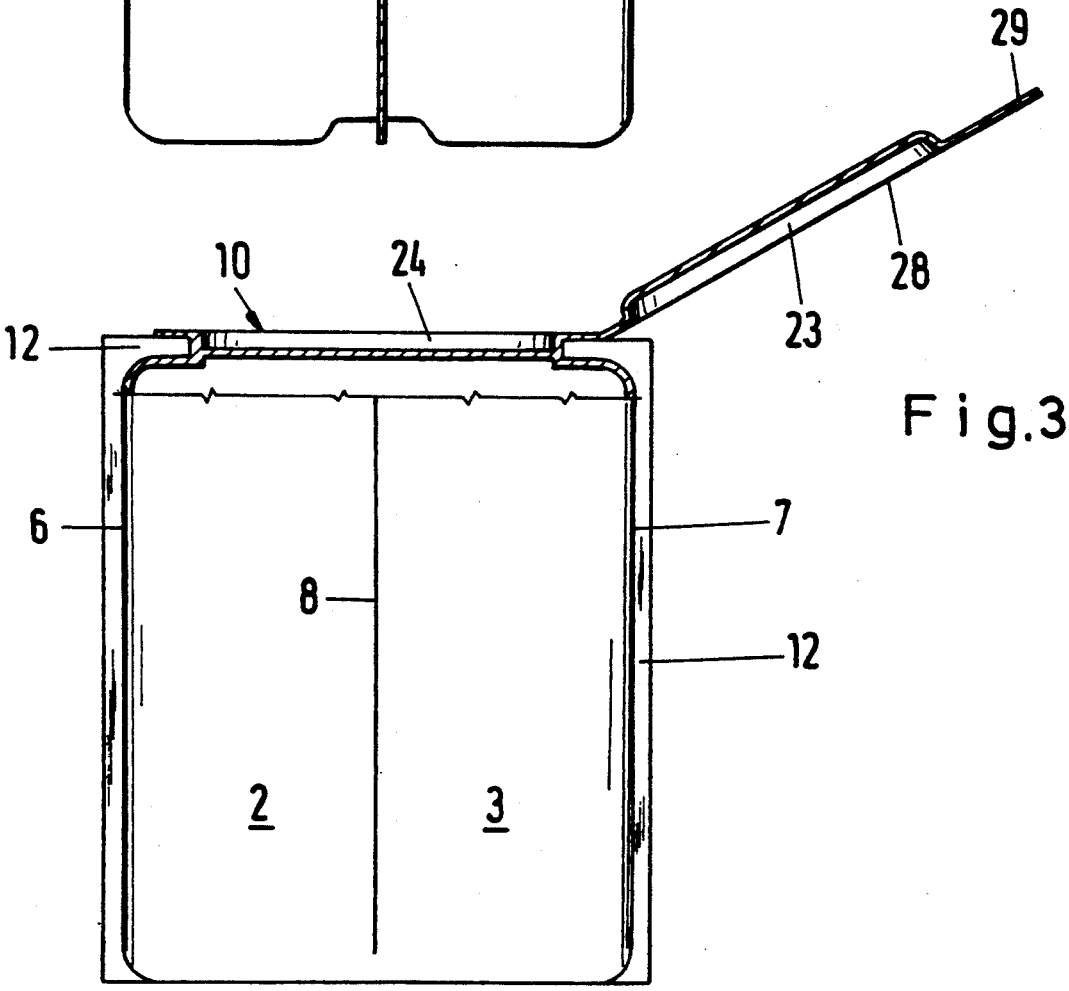
Figure 32:
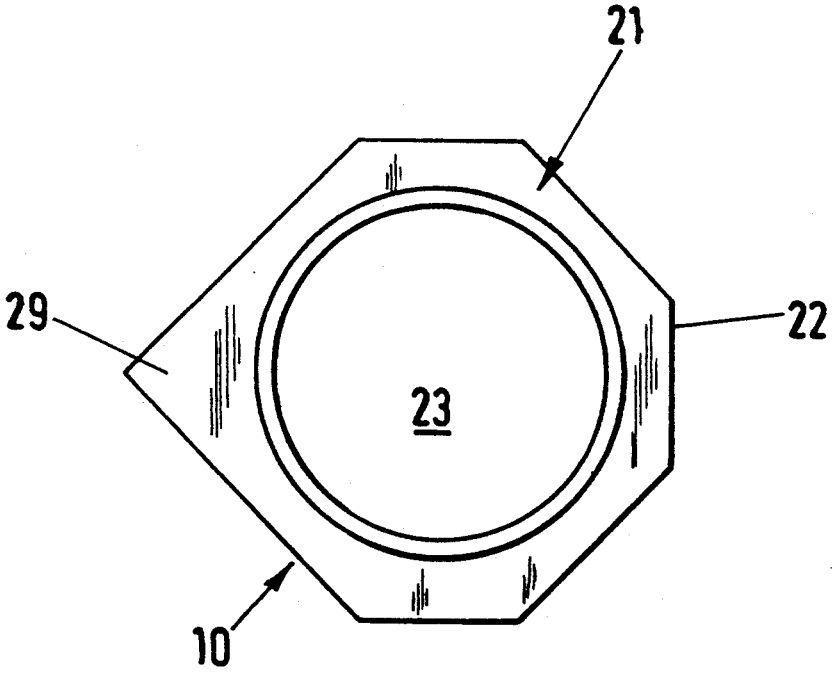

FIG. 1 shows a broken-away vertical view in cross-section of a pouring device which is fitted to the edge of a hole, in an upstanding cylindrical configuration, in the closed condition, FIG. 2 shows the same view as FIG. 1 in the opened condition, FIG. 3 is a view in cross-section of the deep-drawn and stamped-out blank for a pouring device as shown in FIGS. 1 and 2, while still in the condition of lying substantially flat, FIG. 4 is a plan view of three blanks disposed in succession, from a line (not further shown herein) of some hundred blanks, FIG. 5 is a similar view to FIG. 1 but of a second embodiment, FIG. 6 is a plan view of the pouring device shown in FIG. 5 in the closed condition, FIG. 7 is a similar view to FIG. 2 but of the second embodiment, FIGS. 8 and 9 show similar views to those illustrated in FIGS. 3 and 4, but illustrating the second embodiment, FIGS. 10 and 12 show similar views to those illustrated in FIGS. 1, 2, 5 and 7 but showing the third embodiment and also with the sides reversed, because for example the hinge is arranged at the left, FIG. 11 is a similar view to FIG. 6 but showing the third embodiment, FIGS. 13 and 14 are similar views to FIGS. 3 and 4 of the first embodiment and FIGS. 8 and 9 of the second embodiment, but corresponding here to the third embodiment, in association with FIGS. 10 to 12, FIG. 15 is a perspective view of a closed pack wherein the viewer is looking on to the central longitudinal side edge and sees the rear longitudinal side edge at the right and the front longitudinal side edge at the left, FIG. 16 is also a perspective view of the pack but after opening of the pouring device which is arranged at the front in the top wall of the pack, FIG. 17 is a plan view of the closed pack illustrated in FIG. 15, FIG. 18 is a side view of the pack after opening in the condition shown in FIG. 16, FIG. 19 is a rear view of the closed pack when looking forwardly in the direction of the pouring device from the rear longitudinal side edge in FIG. 15, FIG. 20 is a plan view of the pack without an opening portion, wherein the viewer sees only the hole within the depression in the front region of the top wall on to which he is looking, FIG. 21 is a view in cross-section taken along line VII—VII in FIG. 20, FIG. 22 is a broken-away view in cross-section taken along line VIII—VIII in FIG. 20, but only of the upper part of the pack, as is also shown in FIG. 21, FIG. 23 is a view taken along line IX—IX in FIG. 17, FIG. 24 is an individual view showing the broken-line circle in FIG. 23, FIG. 25 is a similar individual view to that shown in FIG. 24, on an enlarged scale, but after the closure portion has been torn open, FIG. 26 is a diagrammatic side view of the opened opening portion, wherein the closure portion is pivoted through 90° about the hinge and projects vertically from the top wall of the pack if the bottom portion is assumed to be disposed in a horizontal position in the top wall of the pack, FIG. 27 is a perspective view of another embodiment of a pack in the opened condition, comparable to the condition shown in FIG. 16, but in which the pouring opening occupies the major part of the top wall, FIG. 28 is a side view of the closed pack of the embodiment shown in FIG. 27, more specifically when viewing on to the front left side wall of the pack so that the right rear longitudinal side edge is invisible to the viewer, FIG. 29 is a plan view of the closed pack shown in FIG. 28, FIG. 30 is a rear view of the closed pack when viewing on to the rear longitudinal side edge forwardly in the direction of the pouring edge, FIG. 31 is a side view of the opened pack of the embodiment shown in FIG. 27 when viewing on to the central longitudinal side edge and the pouring edge is disposed at the left, and FIG. 32 is a plan view of the opening portion in the embodiment shown in FIG. 27.

FIGS. 1 to 14 with the three different embodiments of pouring devices illustrated therein will first be described. The same components are identified by the same references and in comparison with the embodiment shown in FIG. 1 FIGS. 5 to 14 with the other two embodiments are described only in regard to their differences in relation to the first embodiment.

The pouring device which is generally identified by reference numeral 10 is shown in the broken-away views in FIGS. 1, 2, 5, 7, 10 and 12 respectively as being welded in position in the edge 33, which is upstanding in a cylindrical configuration, of the hole 13 of a liquid pack. A specific pack is also described in greater detail hereinafter. At this initial stage it is the pouring device which primarily falls to be considered. The welded seam along which the pouring device 10 is heat-sealed to the edge 33 of the hole 13 in the pack is identified by reference numeral 34. It is of an annular configuration because the hole 13 and also the outside contours of the pouring device 10, corresponding thereto, are of a circular configuration in the embodiments illustrated herein. In the embodiment shown in FIGS. 5 and 7, it is possible to see the impression mark 35 of the welding jaw (not shown) which is applied from the outside and which has formed an impression in the upstanding edge 33 of the hole 13, to produce the annular welded seam 34. Disposed therefore behind the impression mark 35 which is in the form of a groove is the welded seam 34, by means of which the bottom portion 20 is welded in position in the hole 13.

The bottom portion 20 includes various parts thereof. In the three embodiments, the cup-shaped depression 36 with the bottom 37 and the collar or rim 38 upstanding at the edge thereof can be particularly clearly seen from FIGS. 2, 7 and 12. It should be mentioned here that the cup-shaped depression 36 in the bottom portion 20 does not have a bottom or floor in the third embodiment shown in FIGS. 10 to 14. The bottom or floor of the depression is omitted in that embodiment so that it is possible to save all the plastic material required for that purpose.

The closure portion 21 is pivotally connected to the bottom portion 20 by way of a hinge 22.

The closure portion 21 also includes a plurality of parts: a cup-shaped depression 39 with a flat bottom or floor 40 and an upstanding collar 41 at the cylindrical edge thereof. A ring-like gripping means 43 is provided on the closure portion 21 at a location 42 in diametrally opposite relationship to the hinge 22, more specifically being pivotally connected at the location 42 by way of a fold line. This only relates to FIGS. 1 to 9, that is to say the first two embodiments. In that connection, in its centre the ring-like gripping means 43 has a cylindrical annular surface 44 which in the first embodiment as shown in FIGS. 1 to 4 is arranged coaxially with respect to the rim or collar 41 and the collar 38 while in the second embodiment shown in FIGS. 5 to 9 it is extended downwardly beside the connecting location 42 into the cup-shaped depression 39 in the closure portion 21. Before being gripped, the ring-like gripping means 43 is disposed in the cup-shaped depression 39, being attached at 44.

In all embodiments, a tearing line 25 can be seen in the bottom portion 20.

In the first two embodiments, the tearing line 25 is disposed in the bottom 37 of the bottom portion and is in the form of a closed line without a beginning or an end and has a tip 45 as a location at which a force is applied. The tip 45 is admittedly shown as being somewhat rounded off in FIG. 6, but it acts as a location for the application of force and can therefore also be referred to as a tip in connection with FIG. 6, from the point of view of the aim thereof.

In the third embodiment shown in FIGS. 10 to 14 the tearing line 25 is in the form of a straight desired-rupture line and serves as a pouring edge 46 after the closure has been torn away, as shown in FIG. 12.

When looking at the respective closure portion 21 with the pouring device in the closed condition, it will be seen that almost all surfaces of the bottom portion 20 are covered by the closure portion 21.

All three embodiments have a bottom portion 20, at the rim or collar 38 of which is provided a transversely radially outwardly projecting annular surface 47, more specifically at the end of the collar 38 which is towards the closure portion 21.

In the third embodiment shown in FIGS. 10 to 14, the bottom portion 20 does not have a bottom or floor but only the annular collar 38. In the case of a pack for liquid, that would result in leaks which however are eliminated by virtue of the fact that, beginning from one end 48 of the hinge 22, as shown in FIG. 11, a sealing welded line 50 extends substantially transversely to the rectilinear fold edge as a hinge 22 at a spacing beside the collar or rim 41 of the cup-shaped depression 39 of the closure portion 21 to the location 51, and then extends in a V-shape along the converging outside edges 49 to the gripping tip 29 as identified by reference numeral 50'. From the gripping tip 29 the sealing welded seam as now identified by reference numeral 50" extends along the other limb of the V-shape as far as the corner 52 where the two converging outside edges 49 have now diverged again, as viewed in the opposite direction, from the gripping tip 29. From that location 52 the sealing welded seam as now identified by reference numeral 50''' now extends in a straight line and parallel to the sealing welded seam portion 50 to the corner 53 where it again transversely encounters the straight folding edge serving as the hinge 22. It will be seen that the entire space beneath the closure portion 21 is sealed by virtue of the folding line along the hinge 22 on the one hand and the sealing welded seam 50, 50', 50" and 50''' on the other hand. The straight desired-rupture line 25 is also neither adversely affected thereby, nor does it constitute a leakage point.

When the pouring device 10 in accordance with the first two embodiments is torn open, the user grips the ring-like gripping means 43, tears it away from the attachment location 44, opens the folding edge 42 and then pulls the closure portion 21 upwardly, tearing open the tearing line 25, so that a remaining portion of the bottom 37 of the bottom portion 20, more specifically within the tearing line 25, still remains attached to the bottom 40 of the closure portion 21, as can be seen from FIGS. 2 and 7. The pouring device is thus opened.

Reference may now be properly made to FIG. 4 to describe the process for the production of a pouring device of plastic material with a bottom portion 20 and a closure portion 21, which are pivotally movably connected together by way of the hinge 22.

Looking at FIG. 4, shown therein in broken line at the bottom is an endless web 54 from which the individual blanks 56 can be cut by stamping or punching along the edge lines 55 of the blanks 56. However the punching or stamping operation is effected in such a way that only the regions 57 which are shown in hatching for example between the middle and lowermost blank are thrown away as waste. The waste portions are collected in the form of small pieces, melted down and returned to the material for the plastic for forming a new plastic web 54.

Prior to the stamping or punching operation, the deep drawing operation is effected, to go from the flat web 54 into the shape shown in cross-section in FIG. 3, showing some profiles. After the deep drawing operation, the punching or stamping operation is carried out in the described manner, and for the purposes of providing for better folding, a partial cut can be made for example along the doubly shown line 58 from the edge of the web 54 as far as the broken line 22, for example once every ten or one hundred blanks, in order that the finished pouring device 10 can then be better rolled up to form a coil.

After the deep drawing and punching or stamping operations, and possibly after a number of partial cuts 58 have been made, the blank is then folded along its fold lines 22, 42 etc (arrows 59 in FIGS. 3, 8 and 13). The procedure then involves making those welds which are required to join the individual portions of the blanks 56, being therefore in the first two embodiments the welded seam for forming the tearing line 25 and the attachment point 54 for the ring-like gripping means and in the third embodiment being the welding along the desired-rupture line 25 and the sealing welded seam 50, 50', 50'', 50'''.

Along the points 60 and the lines 61 (see FIG. 4), the upper two blanks 56 are joined together in such a way that they are still connected together in a line in the conveyor direction 62.

The pack used in the preferred embodiments described herein, as shown in FIGS. 15 to 26, is intended for milk, juices or the like while the pack shown in FIGS. 27 to 32 is intended for example for yoghurt.

Each respective pack comprises a tube 1 which is of quadrangular cross-section with four sides walls 2, 3, and 4, for the fourth side wall is not shown in any Figure of the drawing. It can be imagined however as being disposed in diametrally opposite relationship to the side wall 3. The four side walls 2 to 4 are separated from each other by longitudinal side edges which are all disposed parallel to the longitudinal centre line 5 of the pack. These involve the front longitudinal side edge 6, the rear longitudinal side edge 7 and the two central longitudinal side edges 8 which are disposed in mutually diametrally opposite relationship between the front and rear longitudinal side edges 6 and 7 respectively. In FIGS. 18, 27 and 31 the central longitudinal side edges are indicated by a line. In actual fact however all the longitudinal side edges are rounded, for which reason it is not possible to see a sharp line 8, particularly in the perspective views. It will be readily appreciated however that four flat side walls 2 to 4 are surrounded by or are separated from each other by four—preferably rounded—edges 6–8. On its underside, the tube is defined by a bottom which is not identified in greater detail, while on its top side it is defined by the top wall 9, wherein the bottom and the top wall are each disposed in a respective plane.

In the first embodiment of the liquid pack, the plane of the top wall 9 can be clearly seen because the pouring device which is generally identified by reference numeral 10 occupies only a small part of the top wall 9, for example an area of from 5 to 30% and preferably from 10 to 20%. In the second embodiment shown in FIGS. 27 to 32 on the other hand the top wall 9 is practically only in the form of a ring beside the pouring device 10.

All parts 1 to 10 of the pack of both embodiments comprise plastic material which can be subjected to deep drawing. FIGS. 19 and 30 show in respect of the two embodiments the outside contour which is substantially quadrangular with a flat top wall 9. So that no parts project substantially beyond the outside contour, thus providing for good stackability and packaging, both the bottom and the top wall 9 have groove-like depressions 11 in which extends a seam 12 which projects substantially vertically from the plane of the top wall 9 or the bottom respectively. The seam 12 extends around the whole of the square configuration or tube 1 of the pack and therefore continues along the front and rear longitudinal side edges 6, 7 in such a way that a plane which extends through the seam 12 which moreover is of a double-wall configuration, as can be particularly clearly seen from FIG. 22 (two seam parts 12' and 12'') precisely divides in half the square configuration of the pack, in the embodiments illustrated herein. The perspective views in FIGS. 15, 16 and 27 and likewise the side views in FIGS. 18 and 31 look perpendicularly on to that plane in which the seam 12 is arranged in the manner of a frame, while FIGS. 19 and 30 are viewing in the direction of the above-mentioned plane and thus also on to the edge of the seam 12. As viewed from the top wall 9, the seam 12 extends from one corner to the opposite corner along the diagonal, as is also the case in regard to the bottom, while however being interrupted in the case of the top wall 9 by the pouring device 10. Along the front and rear longitudinal side edges 6 and 7, without being folded over in any way and stuck on to the outer surface, the seam 12 can stand out perpendicularly without projecting beyond the outside contour of the square configuration, for the longitudinal side edges 6 to 8 of the tube 1 are rounded, and the seam 12 extends in that frame to which the rounded configuration gave rise. Due to the rounded configurations of the longitudinal side edges 6 to 8 on the one hand and due to the groove-like depressions 11 in the bottom and in the top wall of the pack on the other hand, the seam 12 extends within the outside contour of the pack.

It can be particularly clearly seen from FIG. 20 that the seam 12 is interrupted by the hole 13 in the top wall 9. In other words, the seam 12 which extends in a straight line over the top wall 9 terminates in front of the edge 14 of the hole 13, is missing in the region of the hole because there is no material there, and continues again on the opposite side, beyond the hole 13. In regions beside the hole which are shown in FIGS. 21 and 23 and are identified by reference numeral 15, the height of the seam 12 is reduced by from 5 to 30% and preferably by from 10 to 15% of the overall height of the seam 12. As a result, it is possible to insert an opening portion 16 which covers the hole 13, fix it and arrange it in such a way that the pouring device having the opening portion 16 also does not project beyond the outside contour of the pack.

For that purpose, provided in the top wall 9 in which the pouring device 10 is disposed in a widened portion 17 of the otherwise groove-like depression 11, said portion 17 of the depression 11 being widened in such a way that it surrounds the pouring device 10. In other words the pouring device 10 is arranged with its opening portion 16 in such a way that it is disposed in depressed relationship in said portion 17 and also does not project beyond the outer surface of the top wall 9.

FIGS. 15 and 16 clearly show a further depression 18 which is in the form of a handle or gripping recess. Such a recess is also to be envisaged in relation to the second embodiment shown in FIGS. 13 to 18, even though it is not expressly shown therein.

In the second embodiment the seam 12 does not have to pass through a depression in the region of the top wall 9 because the interruption caused by the pouring device 10 occupies practically the whole of the top wall 9. Consequently the surface of the wide depression 17 of the first embodiment is to be assumed to correspond to the top wall 9 for the yoghurt container of the second embodiment.

In the case of a pack of a volume of for example two liters, the depression 18 which provides the gripping or handle recess is arranged in the upper half of each of the rear side walls 3 and 4 respectively, whereby the pack is held and supported by the consumer really close to the centre of gravity so that it is very convenient and easy to pour from the pack.

The surface surrounding the depression 18 (gripping or handle recess) on the side wall 3 and also that on the adjacent side wall 4 which is joined thereto can be arranged to carry printing.

The pouring device 10 is a separate opening portion 16 which is inserted into the hole 13 in the top wall 9 and welded along the edge 14 of the hole 13 in the top wall 9. In order to describe that more accurately, reference is best first directed to FIGS. 20 and 21. Those Figures show the seam 12 which is interrupted by the hole 13 in the top wall 9 and which, in the particularly clear view in FIG. 22, comprises the two limb portions 12', 12'' which are welded together, and extends in the depression 11 or the widened depression 17.

In regard to the shape of the pouring device 10, of the configuration as described in principle in relation to both embodiments illustrated herein, attention is best directed to FIGS. 17, 23 and 26. The pouring device thus consists of the opening portion 16 which is welded into the hole 13 along its annular edge 14. FIG. 23 clearly shows the annular weld region 19 between the opening portion 16 and the hole 13, as indicated by a thicker line. The partly cylindrical ring 14 which is the edge of the hole 13 forms a part of the weld surface 19 for the latter also continues on the top wall 9 and the depressions 15 upwardly on the seam 12.

The opening portion 16 which is welded into the hole 13 in the top wall 9 along the surface 19 in turn comprises a bottom portion 20 and a closure portion 21 which is connected thereto by way of a hinge 22. In order more clearly to see the hinge 22, attention is best directed to FIG. 26, although FIG. 27 also clearly shows the position of the hinge 22 in the second embodiment.

The opening portion 16, that is to say both the bottom portion 20 and also the closure portion 21, has a cup-shaped depression 23, as can be clearly seen in the cross-sectional view in FIGS. 23 and 26. Extending in the 'bottom of the cup' is a weld line 25 which provides the pouring opening 24 which is ultimately desired.

If attention is directed to the closed pouring device 10 shown in FIG. 17, it is possible to see therein in broken line the weld line 25 which towards the front tip of the pouring device 10 is actually provided with a tip 26 in order more specifically to concentrate the tearing-open forces which are still to be described hereinafter, to a point on the weld line, thereby to cause the tearing-open force to be applied to the correct location. The individual view X shown in FIG. 23 which is more clearly illustrated in FIGS. 10 and 11 illustrates a view in cross-section of a part of the weld line 25. Prior to the tearing-open operation, the weld line 25 surrounds the tear-away portion 27 which remains attached to the closure portion 21 after the tearing-open operation, thereby providing the pouring opening 24 in the bottom portion 20.

The plan view of the closed pack as illustrated in FIGS. 17 and 29 is a view in the region of the widened portion 17 of the depression 11 in the top wall 9 of the pouring device which is generally identified by reference numeral 10, on the outer surface of the closure portion 21 with the cup-shaped depression 23, wherein the area of the closure portion 21 surrounding the cup-shaped depression 23 which is of a substantially circular configuration is in the form of a flat plate 28 which is provided at the front with a gripping tip 29. FIG. 23 clearly shows in relation to the first embodiment that the gripping tip 29 of the plate 28 projects in covering relationship over what is referred to as the pouring surface 30 with pouring edge 31.

In use, the final consumer finds the pack shown in FIGS. 15 and 28 to 30, with the pouring device 10 in the closed condition. To open the pack, the consumer grips the gripping tip 29 of the closure portion 21 and pulls it up in the direction of the slanting arrow 32 (FIGS. 24 and 26). By virtue of the weld line 25, the pulling force is concentrated at the tip so that the weld line at the same time also becomes the tear-open line which, after the tearing-open operation, finally opens the pouring opening 24. The tear along the line 25 takes place in the manner diagrammatically shown in FIG. 18 so that the tear-away portion 27 is torn away from the bottom portion 20 and is torn up over the remaining part of the weld line 25, still being attached to the closure portion 21. In that situation, as shown in FIG. 26, the closure portion pivots about the hinge 22 into for example the vertical position, when it moves in the direction indicated by the inclined arrow 32. The pouring opening 24 is opened in that position for the portion 27 is attached to the closure portion 21. The pouring operation can begin. The condition shown in FIG. 16 and FIG. 27 respectively is reached, for both embodiments. When the pack is tilted, the material therein flows over the pouring surface 30 and comes away therefrom along the pouring edge 31, in a clearly definable jet.

To re-close the pack, the closure portion 21 only has to be pivoted downwardly again in the opposite direction to that indicated by the inclined arrow 32 (see FIG. 26).

We claim:

1. A pouring device of plastic material for fitting to an opening of a container for flowable material, which comprises a bottom portion having a cup-shaped depression with a bottom wall and an upstanding collar for engaging with an edge of an open container, said bottom wall having a tearing line for opening the pouring device, and a closure portion having a cup-shaped depression with a bottom wall sealed at least along a part of said tearing line of said bottom wall of said bottom portion and an upstanding collar at the edge thereof pivotally connected to said bottom portion by hinge means.

2. A pouring device according to claim 1 including gripping means of a plate-like or ring-like configuration disposed at a location on said closure portion, preferably in diametrically opposite relationship to said hinge.

3. A pouring device according to claim 1 wherein said tearing line in said bottom of said bottom portion is closed in itself and comprises a loop selected from the group consisting of arcuate segments, linear segments and mixtures thereof.

4. The pouring device according to claim 3 wherein the tearing line comprises a projecting tip.

5. A pouring device according to claim 1 wherein substantially all outer surfaces of said bottom portion can be covered outwardly by said closure portion in a closed condition of said pouring device.

6. A container in combination with the pouring device of claim 1.

7. A container in combination with the pouring device of claim 2.

8. A container in combination with the pouring device of claim 5.

* * * * *